US008273518B2

(12) United States Patent
Kouyama et al.

(10) Patent No.: US 8,273,518 B2
(45) Date of Patent: Sep. 25, 2012

(54) ELECTROPHOTOGRAPHIC TONER, ELECTROPHOTOGRAPHIC DEVELOPER AND PRODUCTION METHOD OF ELECTROPHOTOGRAPHIC TONER

(75) Inventors: Mikio Kouyama, Tokyo (JP); Kenji Hayashi, Tokyo (JP); Hiroaki Obata, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 794 days.

(21) Appl. No.: 12/371,023

(22) Filed: Feb. 13, 2009

(65) Prior Publication Data

US 2009/0208863 A1 Aug. 20, 2009

(30) Foreign Application Priority Data

Feb. 18, 2008 (JP) ..... 2008-035771

(51) Int. Cl.
*G03G 9/08* (2006.01)

(52) U.S. Cl. ..... 430/137.14; 430/137.15

(58) Field of Classification Search ..... 430/137.14, 430/137.15

See application file for complete search history.

(56) References Cited

U.S. PATENT DOCUMENTS

| | | | | |
|---|---|---|---|---|
| 4,965,131 | A * | 10/1990 | Nair et al. | 428/403 |
| 5,576,393 | A * | 11/1996 | Yamashita et al. | 430/137.14 |
| 7,214,463 | B2 * | 5/2007 | Patel et al. | 430/137.14 |
| 2004/0058266 | A1 * | 3/2004 | Matsumura et al. | 430/137.14 |
| 2004/0067429 | A1 * | 4/2004 | Ueda et al. | 430/137.14 |
| 2004/0137344 | A1 * | 7/2004 | Yamashita et al. | 430/137.14 |
| 2007/0087280 | A1 * | 4/2007 | Patel et al. | 430/137.14 |
| 2007/0196757 | A1 * | 8/2007 | Suwabe | 430/137.14 |
| 2007/0269732 | A1 * | 11/2007 | Matsumura et al. | 430/137.14 |
| 2008/0096119 | A1 * | 4/2008 | Yamamoto et al. | 430/137.14 |

FOREIGN PATENT DOCUMENTS

| | | |
|---|---|---|
| JP | 03-015861 | 1/1991 |
| JP | 11-327210 | 11/1999 |
| JP | 2005-091704 | 4/2005 |
| JP | 2006-337395 | 12/2006 |

* cited by examiner

*Primary Examiner* — Christopher Rodee
(74) *Attorney, Agent, or Firm* — Lucas & Mercanti, LLP

(57) ABSTRACT

An electrophotographic toner which is thermally stable in storage or as an image after being fixed and exhibits a sufficiently low melt viscosity and a high fluidity when heated during fixing is disclosed, comprising a colorant and a binder resin, wherein the binder resin contains a poly-branched resin composition in an amount of 0.5 to 20% by mass. There is also disclosed a method of producing the electrophotographic toner.

10 Claims, 3 Drawing Sheets

ELECTROPHOTOGRAPHIC TONER, ELECTROPHOTOGRAPHIC DEVELOPER AND PRODUCTION METHOD OF ELECTROPHOTOGRAPHIC TONER

This application claims priority from Japanese Patent Application No. 2008-035771 filed on Feb. 18, 2008, which is incorporated hereinto by reference.

FIELD OF THE INVENTION

The present invention relates to an electrophotographic toner (hereinafter, also denoted simply as a toner) used for development of electrostatic images in electrophotography, electrostatic recording and electrostatic printing.

BACKGROUND OF THE INVENTION

Image formation in electrophotography is performed according to the following procedure. First, an electrostatic latent image is formed on a photoreceptor by employing a photoconductive material and then, the latent image on the photoreceptor is developed by use of a toner to form a toner image. Subsequently, the toner image on the photoreceptor is transferred onto a transfer material such as paper and thereafter, fixing is performed by employing heat, pressure or solvent vapor to prepare a print. Further, a residual toner on the photoreceptor is cleaned by various means. Image formation is thus performed through the foregoing steps.

Recently, such image forming apparatuses have been employed not only as a copying machine to copy original manuscript but also as a printer to output image data outputted by an office computer or in the field of personal computers. Further reduction in size and weight, enhanced speed and reliability have been severely required from such a background, and machines have been constituted of simpler elements from various points. Meanwhile, performance required for a toner has become higher and it is in such a situation that the foregoing requirements are not fulfilled without attainment of toner performance.

Performance required for a toner include a variety of characteristics such as an electrostatic-charging property and a fixing characteristic. Specifically, a binder resin constituting a toner is required for enhancements of fixing performance onto transfer paper and offset resistance performance. Herein, the offset resistance performance refers to the capability of not allowing a toner to cause cold offset or hot offset at a given temperature, as described below.

In heat roll fixing, for instance, toner particles electrostatic-attached onto transfer paper are passed between heated pressure rolls, melted and fixed onto the transfer paper. However, when the surface temperature of a roll is too low, the whole of a toner particle layer is not sufficiently heated and only the surface portion in contact with the heated roll is softened and adhered to the roll. Any toner on the transfer paper side is not softened, causing no adhesive force, so that the toner layer on the transfer paper is transferred onto the fixing roll side instead of being fixed onto the transfer paper. Such phenomenon is called cold offset.

On the contrary, when the surface temperature of a roll is too high, the viscosity of the melted toner is lowered. Accordingly, the internal cohesive force of the melted toner layer is rapidly lowered, resulting in reduced adhesion onto the heated roll. As a result, the melted toner layer is ruptured and transferred onto both the transfer paper and the fixing roll. Such a phenomenon is called hot offset, often causing adverse staining of the heating roll. A toner adhered to the heated roll is again transferred onto transfer paper and tends to stain non-imaging areas, resulting in lowering of image quality.

Thus, a binder resin constituting a toner is required to exhibit offset resistance performance and not causing cold offset or hot offset within a broad temperature range and also to exhibit superior fixing characteristics.

Further, acceleration of image formation is desired at least in the field of color copiers and color printers. Rapid fixability is required for such acceleration and there is subsequently also desired a toner providing both rapid fixability and low temperature fixability as toner performance.

There were proposed techniques to improve offset resistance, such as addition of an offset inhibitor, and designation of a binder resin with a low molecular weight polymer component and a high molecular weight polymer component. These techniques overcame problems in offset resistance but there still remained problems in compatibility with low temperature fixing, such as an elevated softening point.

There was also proposed a technique in which a binder resin was formed of a styrene-acrylic acid polymer, the molecular weight distribution of such a polymer was broadened without having a high-molecular weight region and a cross-linking structure due to ionic bonding between carboxyl groups of the polymer was formed by use of a metal compound. Such a technique was expected to achieve a substantially increased molecular weight and realize enhanced offset resistance, as described in, for example, JP-A No. 110156 (hereinafter, the term JP-A refers to Japanese Patent Application Publication). However, such a toner used for development of electrostatic images was composed of a large amount of a metal compound, so that such a metal compound exhibited catalytic action with depending on conditions, resulting in tendency of the resin in the toner being easily gelled. Accordingly, offset resistance was enhanced but there were problems such as deteriorated low temperature fixability.

There was also known the use of a high-acid value polyester resin used for a binder resin, which was targeted for low temperature fixing. There was proposed, for example, a toner containing a polyester resin having a prescribed acid value, hydroxy group value, molecular weight distribution and tetrahydrofuran-insoluble component, as described in, for example, JP-A No. 9-204071. However, such a proposal simultaneously resulted in lowering of low temperature fixability and a lowered melting temperature tended to deteriorate offset resistance. To realize a toner compatible in low temperature fixability and offset resistance was required a further extensive study.

There have been studied methods of introducing a cross-linking component or a polymeric component into a binder resin to achieve an expanded fixing temperature range or enhanced offset resistance in the prior art. However, a technique for introduction of a cross-linking component made it difficult to control cross-linking density. Specifically, an emulsion association method in which a sub-micron resin particle dispersion was mixed with a colorant dispersion to prepare toner particles through coagulation and fusion made it difficult to control the particle shape. On the other hand, a method of introducing a polymeric component required excessive thermal energy to control the particle shape, due to increased viscosity of the binder resin and also resulted in increased melt viscosity during fixing, which became disadvantageous conditions for achievement of low temperature fixing.

SUMMARY OF THE INVENTION

The present invention is directed to solve the foregoing problems in the prior art. Thus, it is an object of the invention to provide an electrophotographic toner which simultaneously achieves enhancements of offset resistance and low temperature fixability, is thermally stable in storage or as an image after being fixed, and exhibits a sufficiently low melt viscosity and a high fluidity when heated during fixing.

There has been studied a toner capable of simultaneously achieving enhanced offset resistance and enhanced low temperature fixability. Thus, there has been studied a design of a toner which is capable of performing stable storage without causing blocking under a high temperature environment, while lowering the glass transition temperature and is also capable of exhibiting a low melt viscosity and high fluidity at a heating temperature lower than conventional one. In the invention, a resin constituting a toner was noted and it was found that a poly-branched resin constituted of a polymeric chain having plural branched chains was contained in a toner-constituting resin at an amount falling within a specific range, rendering it feasible to obtain a toner having the performance sought above.

Thus, it was found that the above-mentioned problems could be overcome by the following constitution.

One aspect of the invention is directed to an electrophotographic toner comprising a colorant and a binder resin, wherein the binder resin contains a poly-branched resin composition in an amount of 0.5 to 20% by mass.

Another aspect of the invention is directed to an electrophotographic developer comprising an electrophotographic toner, as described above.

Another aspect of the invention is directed to a method of producing an electrophotographic toner comprising the steps of dissolving at least a poly-branched resin composition in a radical-polymerizable monomer to form a monomer mixture, emulsifying the monomer mixture to form a monomer emulsion, allowing the monomer emulsion to polymerize to form resin microparticles containing a poly-branched resin and allowing the resin microparticle and colorant microparticles to coagulate and fuse to form toner particles.

Another aspect of the invention is directed to an image forming method comprising forming an electrostatic latent image on the surface of a latent image support and developing the electrostatic latent image to form a toner image.

According to the invention, there were realized an electrophotographic toner capable of simultaneously achieving low temperature fixability and offset resistance, an electrophotographic developer using the toner, preparation method of the toner and an image forming method.

DETAILED DESCRIPTION OF THE INVENTION

Figure 1:
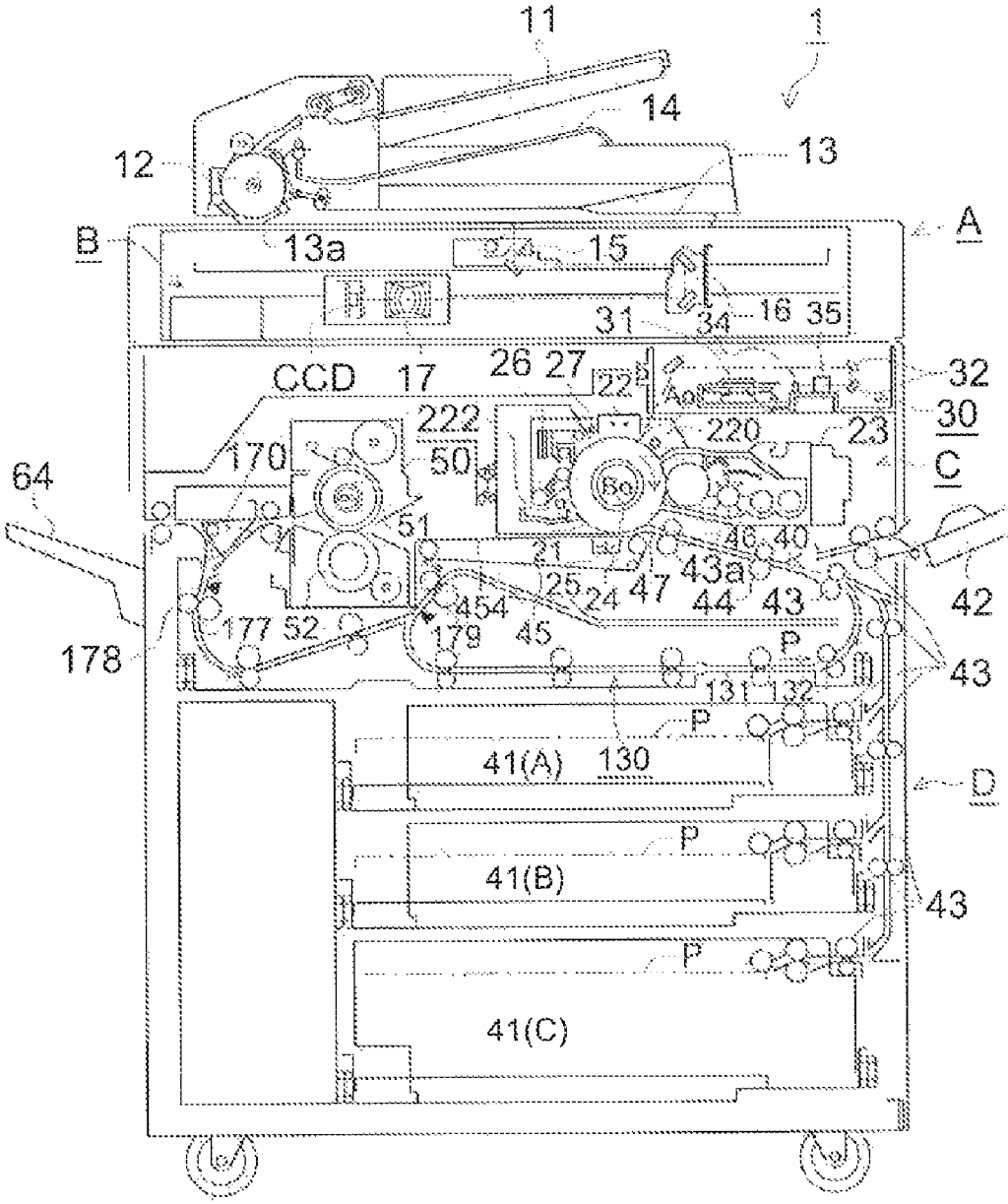
FIG. 1 illustrates the sectional view of an image forming apparatus usable in the invention.

The present invention is related to an electrophotographic toner (hereinafter, also denoted simply as a toner).

In electrophotographic image forming apparatuses, there have been studied fixing of a toner image at a temperature lower than ever before, so-called low temperature fixing techniques. Expanding the fixing temperature range of a toner have been studied as one of techniques to realize low temperature fixing.

Methods for expanding the fixing temperature range of a toner include, for example, a technique of introducing a cross-lining component or a high-molecular weight component into a binder resin. However, introduction of a cross-linking component resulted in difficulty in controlling the cross-linking density within a binder resin, rendering it difficult to achieve the targeted sufficiently low temperature fixability. Specifically, an emulsion association method in which toner particles are prepared through the steps of mixing a resin particle dispersion and a colorant dispersion, followed by coagulation and heat-fusion thereof, also rendered it difficult to control particle shape. Further, introduction of a high-molecular weight component required an excessively large amount of thermal energy when controlling a particle shape with increased viscosity of a binder resin, resulting in increased melt viscosity in fixing and rendering it disadvantageous to achieve low temperature fixability.

A toner capable of realizing low temperature fixability requires a balance competing performances such that thermal stability of a toner image during storage or after being fixed is sufficient, and low melt viscosity and high fluidity are achieved when heated in fixing.

In the invention, it was found that a toner having the above-described characteristics was obtained by inclusion of the poly-branched resin described below at a specific amount in a binder resin constituting the toner. The following is the reason that incorporation of such a poly-branched resin to a binder resin constituting a toner rendered it feasible to achieve competing performances such as storage stability and low temperature fixability.

In the toner of the invention, it is assumed that a binder resin segment and a poly-branched resin segment become moderately entangled with each other to form an entangled state and such entanglement of both segments, whereby sufficient strength is maintained, compared to a constitution of straight-chained resin. While such an entangled state formed by poly-branched resin segments is untangled upon heating at an unexpectedly high-speed, whereby the melt viscosity is rapidly lowered and fixing at a relatively low temperature becomes feasible.

The present invention will be further detailed in the following.

First, there will be described a poly-branched resin composition used in the invention. In the invention, the poly-branched resin composition refers to a composition of a resin containing a molecular component constituted of a backbone component having at least two branched chains. Specifically, the poly-branched resin composition can be formed by performing polymerization with addition of a polymerization initiator to a mixture of a compound having at least two vinyl groups (hereinafter, also denoted as a poly-functional vinyl compound) and a radical-polymerizable monomer.

Examples of such a compound containing at least two vinyl groups include:

a divinylbenzene;

an alkylene glycol di(meth)acrylate such as ethylene glycol di(meth)acrylate, 1,3-butylene glycol di(meth)acrylate and 1,6-hexanediol di(meth)acrylate;

a polyoxyalkylene glycol di(meth)acrylate such as diethylene glycol di(meth)acrylate, tetraethylene glycol di(meth) acrylate and tetrapropylene glycol di(meth)acrylate;

a tri-functional vinyl compound (that is a compound containing three vinyl groups) such as trimethylolethane tri (meth)acrylate, trimethylolpropane tri(meth)acrylate and pentaerythritol tri(meth)acrylate;

a tetra-functional vinyl compound (that is a compound containing four vinyl groups) such as tetramethylolmethane tetra(meth)acrylate, and pentaerythritol tetra(meth)acrylate; and a compound having a branched chain containing a repeating unit represented by the following formula (1), which is also called poly-branched macromonomer:

formula (1)

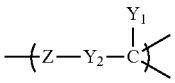

wherein $Y_1$ is an electron-withdrawing group selected from the group consisting of —CN, —$NO_2$, —$CONH_2$, —CON$(R)_2$, —$SO_2CH_3$, and —P(=O)$(OR)_2$, in which R is an alkyl group or an aryl group; $Y_2$ is a group selected from the group consisting of an arylene group, —O—CO— and —NH—CO—; Z is a group selected from the group consisting of —$(CH_2O)_n$—, —$(CH_2CH_2O)_n$— and —$(CH_2CH_2CH_2O)_n$—, and when $Y_2$ is —O—CO— or —NH—CO—, Z is a group selected from the group consisting of —$(CH_2)_n$—, —$(CH_2)_n$—Ar—, —$(CH_2O)_n$—Ar—, —$(CH_2CH_2O)_n$—Ar— and —$(CH^2CH_2CH_2O)_n$—Ar—, in which Ar is an arylene group.

Herein, $Y_2$ is, for example, an arylene group selected from the group consisting of the following formulas:

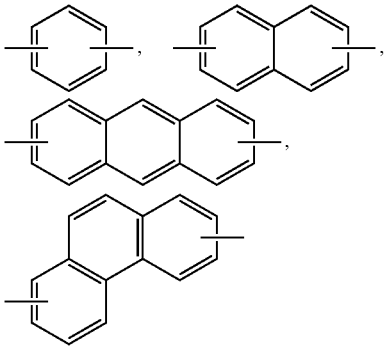

Of the foregoing poly-branched macromonomers, $Y_1$ is suitably —CN and $Y_2$ is suitably a phenylene group. When $Y_2$ is a phenylene group Z may be bonded at any of o-, m- and p-positions. The repeating number, n is not specifically limited but preferably from 1 to 12, and more preferably from 2 to 10 in terms of solubility in styrene.

A poly-branched can be obtained in such a manner that, in the presence of a basic compound, (1) an AB2 type monomer having in the molecule a active methylene group and a leaving group in nucleophilic displacement reaction of the active methylene group is allowed to react through nucleophilic displacement reaction to obtain a poly-branched self-condensation type polycondensation product (condensation polymer) as a precursor, and then, (2) an unreacted active methylene group remained in the polycondensation product or a methine group is reacted, through nucleophilic displacement reaction, with a compound having a double bond directly attached to an aromatic ring and a leaving group in nucleophilic displacement reaction of the active methylene group in the molecule.

The leaving group in nucleophilic displacement reaction of the active methylene group is a halogen, —OS(=O)$_2$R (in which R is an alkyl group or an aryl group) or the like; specific examples thereof include bromine, chlorine, a methylsulfonyloxy group and a tosyloxy group.

Strong alkalis such as sodium hydroxide and potassium hydroxide are suitable as a basic compound, which are used as solution in reaction.

Examples of a AB2 type monomer having in the molecule a active methylene group and a leaving group in nucleophilic displacement reaction of the active methylene group include halogenated alkoxy-phenylacetonitriles such as bromoethoxy-phenylacetonitrile and chloromethylbenzyloxy-phenylnitrile; and phenylacetonitriles such as tosyloxy-(ethyleneoxy)-phenylacetinitrile and tosyloxy-di(ethyleneoxy)-phenylacetonitrile.

Representative examples of a compound having, in the molecule, a double bond directly attached to an aromatic ring and a leaving group in nucleophilic displacement reaction of the active methylene group include chloromethylstyrene and bromomethylstyrene.

The foregoing (1) of a poly-branched self-condensation type condensation polymer specifies a condensation polymer as a precursor and the foregoing (2) explains a reaction of introducing a double bond directly attached to an aromatic ring to the precursor to synthesize a poly-branched macromonomer. The reaction (1) and the reaction (2) can be performed successively but can also be simultaneously performed in an identical system. The molecular weight of a poly-branched macromonomer can be controlled by varying a mixing ratio of a monomer and a basic compound.

In the invention, of the foregoing poly-functional vinyl compounds (compounds containing at least two vinyl groups) are preferred tri- or more-functional vinyl compounds (compounds containing at least three vinyl groups).

Such a poly-functional vinyl compound is used in an amount of from 1 to 1500 ppm, preferably from 10 to 1000 ppm, and more preferably from 50 to 800 ppm, based on the mass of a radical-polymerizable monomer.

A poly-branched resin composition used in the invention can be obtained by use of a poly-functional chain transfer agent that is a chain transfer agent having at least two chain transfer units and a radical-polymerizable monomer. Examples of such poly-functional chain transfer agent include a poly-functional mercaptan compound, which has at least two thiol groups in the molecule and is represented by the following formula (2):

$$R\text{-}[(A)_m\text{-}SH]_n \qquad \text{Formula (2)}$$

wherein R is an aliphatic having 1 to 17 carbon atoms, an aromatic group or an organic group containing a heteroatom, A is an organic group, S is a sulfur atom, m is an integer of 0 or 1 and n is an integer of 2 to 4.

Examples of an aliphatic or aromatic hydrocarbon group include an alkyl group (alkyl group having 1 to 17 carbon atoms, e.g., methyl, ethyl, or propyl) a cycloalkyl group (cycloalkyl group having 4 to 17 carbon atoms, e.g., cyclopentyl, cyclohexyl), an alkenyl group (alkenyl group having 2 to 17 carbon atoms, e.g., vinyl, allyl), a cycloalkenyl group an aryl group and an aralkyl group. The organic group containing a heteroatom is preferably a cyclic organic group, specifically, in which a heteroatom forms a ring, including, for example, a nitrogen-containing 5- to 8-membered heterocyclic ring such as a pyrrole, pyrrolidine, piperazine, pyridine or triazine ring, an oxygen-containing 5- to 8-membered heterocyclic ring such as a furan ring, a sulfur-containing 5- to 8-membered ring such as a thiopyrane ring, a 5- to 8-membered heterocyclic ring containing at least two heteroatoms selected from an oxygen atom and a nitrogen atom, such as an oxazolidine, oxazoline, oxazine, oxadiazole or oxatriazole ring, a 5- to 8-membered heterocyclic ring containing at least two heteroatoms selected from an nitrogen atom and a sulfur atom, such as a thiazane, thiazine, thiazoline, thiazolidine, thiazole, thiadiazine, thiadiazoline or thiadiazole ring, and a 5- to 8-membered heterocyclic ring containing a nitrogen atom oxygen atom and sulfur atom, such as an oxathiazine ring. Further, "R" includes an alkyl group having 4 to 8 carbon atoms (e.g., neopentyl, neohexyl) and a triazine group (e.g., 1,3,5-triazine).

Examples of the organic group A include an alkylene group (alkylene group having 1 to 4 carbon atoms such as a methylene or ethylene group), an oxyalkylene group (oxyalkylene group having 1 to 4 carbon atoms such as oxymethylene or oxyethylene), an ester group (ester group having 2 to 6 carbon atoms, such as —$OCOCH_2$—, —$OCOCH_2CH_2$— or —$OCOCH_2CH_2CH_2$—), a cycloalkylene group (cycloalkylene group having 4 to 8 carbon atoms, such as cyclohexylene group) and an arylene group.

In the formula (2), m is an integer of 0 or 1 and n is an integer of 2 to 4, and preferably 3 or 4.

Examples of a poly-functional mercaptan compound include a di-function mercaptan compound (having two thio groups in the molecule), tri-functional mercaptan compound (having three thio groups in the molecule) and a tetra-functional mercaptan compound (having four thio groups in the molecule).

Specific examples of a di-functional mercaptan compound include an ethylene glycol thiocarboxylic acid diester such as ethylene glycol bisthioglycolate and ethylene glycol bisthiopropionate; and dimethylopropane thiocarboxylic acid diester such as dimethylolpropanebisthioglycolate, dimethylolpropane bisthiopropionate and dimethylolpropane bisthiobutanate.

Specific examples of a tri-functional mercaptan compound include trimethylolpropane tristhioglycol, trimethylolpropane tristhiopropionate, trimethylolpropane tristhiobutanate and 1,3,5-triazine-2,4,6-trithiol. Compounds may be used singly or in combination. Specific examples of a tetra-functional mercaptan compound include pentaerythritol tetrakisthioglycolate, pentaerythritol tetrakisthiopropionate, pentaerythritol tetrakis(4-mercaptobutanate) and pentaerythritol tetrakis(6-mercaptohexanate).

These poly-functional mercaptan compounds may used singly or in combination. Polyfunctional polymerization initiators usable in the invention include, for example, a peroxide compound and an azo compound. Such a polyfunctional polymerization initiator is used in an amount of from 1 to 3000 ppm, and preferably from 10 to 2000 ppm, based on the mass of a radical-polymerizable monomer.

A poly-branched resin composition usable in the invention is obtained by use of a poly-functional polymerization initiator, that is, a polymerization initiator having at least two radical polymerization initiator units and a radical-polymerizable monomer. Examples of a poly-functional polymerization initiator include a peroxide compound and an azo compound. There are also usable commonly known poly-functional polymerization initiators.

Compounds represented by the following formulas are usable as a poly-functional polymerization initiator having at least three functional groups (or radical polymerization initiator units) capable of initiating polymerization:

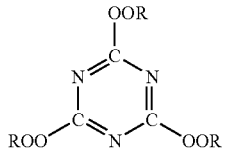

wherein R is a tertiary alkyl group, and examples of a tri-functional peroxide compound represented by the foregoing formula include tris(t-butylperoxy)triazine, tris(t-amylperoxy)triazine, tris(di-t-butylperoxy)triazine and tris(di-cumylperoxycyclohexyl)triazine;

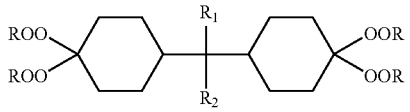

wherein R is a tertiary alkyl group or a tertiary aralkyl group, and $R_1$ and $R_2$ are each an alkyl group having one or two carbon atoms, and examples of a tetra-functional peroxide compound include 2,3-bis(4,4-di-t-butylperoxycyclohexyl)propane, 2,2-bis(4,4-di-t-hexylperoxycyclohexyl)propane, 2,2-bis(4,4-di-t-octylperoxycyclohexyl)propane, 2,2-bis(4,4-di-t-amylperoxycyclohexyl)propane, 2,2-bis(4,4-di-cumylperoxycyclohexyl)propane and 2,2-bis(4,4-di-t-butylperoxycyclohexyl)butane;

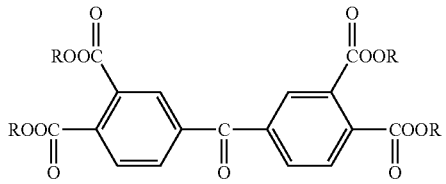

wherein R is a tertiary alkyl group or a tertiary aralkyl group, and examples of a tetra-functional peroxide compound include 3,3',4,4'-tetra(t-butylperoxycarbonyl)benzophenone, 3,3',4,4'-tetra(t-hexylperoxycarbonyl)benzophenone, 3,3',4,4'-tetra(t-hexylperoxycarbonyl)benzophenone, and 3,3',4,4'-tetra(t-cumylperoxycarbonyl)benzophenone.

Azo compounds usable as a polymerization initiator include, for example, 2,2-azobis(2-methylbutyronitrile) and 2,2-azobis(cyclohexane-1-carbonitrile).

These polymerization initiators may be use singly or in combination. Of the foregoing polymerization initiators is preferred a poly-functional peroxide compound, and poly-functional peroxide compounds represented by the foregoing formulas are specifically preferred.

The foregoing polymerization initiator may be added to a polymerization system (a solution of a polymerization raw material or a solution in the course of polymerization) in any step for polymerization of a styrene monomer but is generally added to a solution of a polymerization raw material and may also be added to a solution in the course of polymerization with optionally dividing to plural times.

The foregoing polymerization initiator is used in an amount of from 20 to 3000 ppm, and preferably from 50 to 2000 ppm, based on the mass of radical-polymerizable monomer.

There will be described preparation of a poly-branched resin composition used in the invention.

A poly-branched resin composition used in the invention can be synthesized by the combination of a poly-functional vinyl compound and a radical-polymerizable monomer, a poly-functional chain transfer agent and a radical-polymerizable monomer, or a poly-functional polymerization initiator and a radical-polymerizable monomer. Specifically, in the case of the formed two combinations, that is, in the case of the combination of a poly-functional vinyl compound and a radical-polymerizable monomer, or that of a poly-functional chain transfer agent and a radical-polymerizable monomer, there is feasible thermal polymerization or polymerization at a desired polymerization temperature by addition of a polymerization initiator. In the latter case, that is, in the case of a poly-functional polymerization initiator and a radical-polymerizable monomer, there is feasible polymerization at a desired temperature or by the combination with an other polymerization initiator.

Further, polymerization is also feasible by the combination of the foregoing combinations.

Radical-polymerizable monomers include vinyl monomers (1) through (10), as below:

(1) Styrene and styrene derivatives:

styrene, o-methylstyrene, m-methylstyrene, p-methylstyrene, α-methylstyrene, p-phenylstyrene, p-ethylstyrene, 2,4-dimethylsytyrene, p-tert-butylstyrene, p-n-hexylstyrene, p-n-dodecylstyrene, p-n-octylstyrene, p-n-nonylstyrene, p-n-decylstyrene, and p-n-dodecylstyrene;

(2) methacrylic acid ester derivatives:

methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate;

(3) acrylic acid ester derivatives:

methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate;

(4) olefins:

ethylene, propylene, and isobutylene;

(5) vinyl esters:

vinyl propionate, vinyl acetate, and vinyl benzoate;

(6) vinyl ethers:

vinyl methyl ether, and vinyl ethyl ether;

(7) vinyl ketones:

vinyl methyl ketone, vinyl ethyl ketone, and vinyl hexyl ketone;

(8) N-vinyl compounds:

N-vinylcarbazole, N-vinyl indole, and N-vinylpyrolidone;

(9) vinyl compounds:

vinylnaphthalene, and vinylpyridine;

(10) acrylic acid or methacrylic acid derivatives:

acrylonitrile, methacrylonitrile, and acrylamide.

Of the foregoing radical-polymerizable monomers, specifically, styrenes and (meth)acrylates may be used singly or copolymerized with other monomers.

The poly-branched resin composition used in the invention can be prepared by commonly known bulk polymerization or solution polymerization. Continuous bulk polymerization is also preferably employed. In cases when using a poly-functional vinyl compound, for example, such a poly-functional vinyl compound and a radical-polymerizable monomer are homogeneously mixed and polymerized at a polymerization temperature of 140 to 200° C. until a polymerization conversion rate reaches at least 60%, and preferably at least 70%. The thus obtained polymer mixture is introduced to a preheater of 200 to 280° C. (preferably 220 to 270° C.) and then allowed to pass through a vacuum degassing bath at 200 to 280° C. (preferably 20 to 270° C.) to remove and recover unreacted monomers, whereby an objective poly-branched resin composition is obtained. In cases of other combinations, a poly-branched resin composition can be obtained similarly.

A toner containing a poly-branched resin composition can be obtained as follows. A poly-branched resin composition is added in an intended amount to a monomer composition of a binder resin constituting a toner, after being optionally heated to perform sufficient dissolution, is added to an aqueous surfactant solution and is subjected to a dispersion treatment by an ultrasonic homogenizer or a high-speed stirrer. The monomer composition containing a poly-branched resin composition is thus emulsified. Then, after the thus obtained emulsion is adjusted a prescribed temperature, a polymerization initiator is added thereto to undergo polymerization reaction over a given time, whereby a dispersion of poly-branched resin particles containing a poly-branched resin composition, a so-called latex is obtained. Preferably, when a poly-branched resin composition is dissolved, a monomer composition which contains a solution of a mold-releasing agent such as a paraffin or a long chain alkyl ester, is emulsified and polymerized, whereby a dispersion (latex) of resin particles encapsulating a releasing agent and a poly-branched resin composition is obtained. Further, resin particles contained in the thus obtained resin particle dispersion are used as seed particles, and a mixture of a monomer composition and a polymerization initiator is dropwise added to the seed particles to perform polymerization and the obtained particles are usable as a resin for a toner.

The glass transition temperature of a binder resin except for a poly-branched resin composition is preferably set a range of from 25 to 75° C., and specifically, a binder resin to achieve low temperature fixability preferably exhibits a glass transition temperature of 25 to 45° C.

The poly-branched resin composition used in the invention has a long-chained, branched structure obtained by polymerization of the above-described monomer and poly-functional compound and exhibits a mass average branch number ($N_w$) falling within a range of from 0.1 to 10, which is calculated from the linear-reduced mass average molecular weight (that is molecular weight in terms of linear polystyrene equivalent mass average molecular weight and also is denoted simply as mass average molecular weight or MwL) determined by gel permeation chromatography (GPC) and a mass average molecular weight obtained in the CPC/MALLS method. When the nw of a poly-branched resin composition falls within a range of 0.1 to 10, a toner containing such a poly-branched resin composition can achieve sufficient strength and fluidity and can maintain superior toner shape controllability without causing gelling, while exhibiting stable fixability.

The foregoing mass average branch number ($N_w$) is calculated from a linear-reduced mass average molecular weight determined by gel permeation chromatography (GPC) and a mass average molecular weight obtained by the GPC/MALLS method. The mass average branch number ($N_w$) can be determined by the methods described in J. Chem. Phys. 17, 1301 '1949) and J. Appl. Polm. Sci. vol. 33, page 1909.

(1) Determination of Linear-Reduced Mass Average Molecular Weight by GPC ($M_wL$):

GPC: Using a column, TSK GELGMH 6 (product by TOSO Co., Ltd.) in RI detector M410 (product by Water Co.), measurement is conducted to determine a $M_wL$ under conditions:

Solvent: tetrahydrofuran

Flow rate: 1.0 ml/min

Temperature: 40° C.

Concentration: 0.2 mass part/100 ml

Injection amount: 200 micro-liter

Calculation of molecular weight was executed by employing a standard calibration curve prepared by using a standard polystyrene (product by TOSO Co. Ltd.).

(2) Linear-Reduced Mass Average Molecular Weight ($M_wL$) and Linear-Reduced (z+1)-Average Molecular Weight [Also Denoted as $M_{(z+1)}L$] are Calculated According to the Following Equations:

$$M_wL=\Sigma(w_iM_i^n)/\Sigma[w_iM_i^{(n-1)}]\text{when } n=1,$$

$$M_{(z+1)}L=\Sigma(w_iM_i^n)/\Sigma[w_iM_i^{(n-1)}]\text{when } n=3,$$

where the foregoing wi represents a mass fraction in elution volume (vi) and Mi represents a molecular weight in elution volume (vi).

(3) Measurement of Mass Average Molecular Weight (MwB) by GPC/MALLS Method

The MwB is measured under the following conditions by using a light scattering photometer Dawn F Photometer (product by Wyatt Co.), an IR detector Miran-1A (product by Foxbor Co.) and a column Shodex (UT 806L):

Solvent: 1,2,4-trichlorotoluene (containing 0.033 w/v% of 3,5-di-tert-butyl-4-hydroxytoluene), Flow rate: 1.0 ml/min Temperature: 135° C.

Injection amount: 200 micro-liter

Concentration 0.7 mass part/100 ml (4) Calculation of Mass Average Branch Number (nw):

The mass average branch number (nw) can be calculated by the method described in B. H. Zimm & W. H. Stokmayer, J. Appl. Polym. Sci., 1909 (1987).

Thus, from MwL determined in the foregoing (1) and MwB determined in the foregoing (3), g=((MwL/MwB) 1.138 is determined, and from g=1/nw×1n(1+nw), nw is determined.

There will be described constituent materials of a Loner relating to the invention.

Examples of a colorant usable in the invention include carbon black such as Channel black, Furnace Black, Channel Black, Acetylene Black, Thermal Black and Lamp Black and magnetic powder such as magnetite and ferrite.

Examples of magenta or red colorants include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48; 1, C.I. Pigment Red 53; 1, C.I. Pigment Red 57; 1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red177, C.I. Pigment Red 178, and C.I. Pigment Red 222.

Examples of orange or yellow colorants include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, and C.I. Pigment Yellow 138.

Examples of green or cyan colorants include C.I. Pigment Blue 15, C.I. Pigment Blue 15; 2, C.I. Pigment Blue 15; 3, C.I. Pigment Blue 15; 4, C.I. Pigment Blue 16, C.I. Pigment Blue 60, C.I. Pigment Blue 62, C.I. Pigment Blue 66 and C.I. Pigment Green 7.

These colorants may be used singly or in combination. A colorant is incorporated in an amount of from 1 to 30% by mass and preferably from 2 to 20% by mass, in which a mixture of these colorants may be used. The number average primary particle size of a colorant depends of its kind but preferably from approximately 10 to 200 nm.

A colorant is added at the stage of coagulating resin particles with a coagulant to dye a polymeric material. There may be used a colorant which has been subjected to a surface treatment by use of a coupling agent.

There will described a wax usable in the invention. A wax usable in the invention includes commonly known wax and specific examples thereof include:

(1) Long chain hydrocarbon wax:

polyolefin wax such as polyethylene wax and polypropylene wax, paraffin wax and sazole wax;

(2) Ester wax:

trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol stearate, trimellitic acid tristearate, and distearyl maleate;

(3) amide wax:

ethylenediamine dibehenylamide and trimellitic acid tristearylamide;

(4) dialkyl ketone wax:

distearyl wax;

(5) other wax:

Carnauba wax and montan wax.

The melting point of a wax is usual in the range of from 40 to 160° C., preferably from 50 to 120° C., and more preferably from 60 to 90° C. When a melting point falls within the foregoing range, heat resistance of a toner is secured and toner image formation is performed without causing cold offset even when fixing at low temperature. The content of a wax in a wax is preferably from 1 to 30% by mass, and more preferably fro 5 to 20% by mass.

There will be further described a polymerization initiator, a chain transfer agent and a surfactant usable in preparation of the toner described above.

Resin constituting the toner particles relating to the invention can be prepared by polymerization of polymerizable monomers. Radical polymerization initiators usable in the invention are those described below. Specifically, when forming resin particles through emulsion polymerization, oil-soluble polymerization initiators are usable. Examples of an oil-soluble polymerization initiator include azo- or diazo-type polymerization initiators, e.g., 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile, azobisisobutylonitrile; peroxide type polymerization initiators, e.g., benzoyl peroxide, methyl ethyl ketone peroxide, diisopropylperoxycarbonate, cumene hydroperoxide, t-butyl hydroperoxide, di-t-butyl peroxidedicumyl peroxide, 2,4-dichlorobenzoyl peroxide, lauroyl peroxide, 2,2-bis-(4,4-t-butylperoxycyclohexyl)-propane, tris-(t-butylperoxy)triazine; and polymeric initiators having a side-chain of peroxide.

Water-soluble radical polymerization initiators are usable when forming particulate resin through emulsion polymerization. Examples of a water-soluble polymerization initiator include persulfates such as potassium persulfate and ammonium persulfate; azobisaminodipropane acetic acid salt, azobiscyanovaleric acid and its salt, and hydrogen peroxide.

Conventionally used chain-transfer agents are usable for the purpose of adjustment of the molecular weight of resin constituting composite resin particles. Chain-transfer agents are not specifically limited and examples thereof include mercaptans such as octylmercaptan, dodecylmercaptan and tert-dodecylmercaptan; n-octyl-3-mercaptopropionic acid ester; terpinolene; carbon tetrabromide and α-methylstyrene dimmer.

Dispersion stabilizers are also usable for moderate dispersion of polymerizable monomers in a reaction system Examples of a dispersion stabilizer include calcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina. Further, polyvinyl alcohol, gelatin, methylcellulose, sodium dodecybenzenesulfate, ethylene oxide adduct, sodium higher alcohol-sulfate and the like, which are generally usable as a surfactant, are also usable as a dispersion stabilizer.

There are used surfactants to form resin particles in an aqueous medium. Thus, to perform polymerization using radical-polymerizable monomers, surfactants are used to disperse such monomers in the form of oil droplets in an aqueous medium. Surfactants usable therein are not specifically limited but ionic surfactants described below are preferred. Such ionic surfactants include sulfates (e.g., sodium dodecylbenzenesulfate, sodium arylalkylpolyethersulfonate, sodium 3,3-disulfondisphenylurea-4,4-diazo-bis-amino-8-naphthol-6-sulfonate, ortho-carboxybenzene-azo-dimethylaniline, sodium 2,2,5,5-tetramethyl-triphenylmethane-4,4-diazo-bis-β-naphthol-6-sulfonate) and carboxylates (e.g., sodium oleate, sodium laurate, sodium caprate, sodium caprylate, sodium caproate, potassium stearate, calcium oleate).

Nonionic surfactants are also usable. Examples thereof include polyethylene oxide, polypropylene oxide, a combination of polypropylene oxide and polyethylene oxide, an ester of polyethylene glycol and a higher fatty acid, alkylphenol polyethylene oxide, an ester of polypropylene oxide and a higher fatty acid, and sorbitan ester.

Next, there will be described preparation methods of an electrophotographic toner.

The toner is prepared via the following steps:

(1) dissolution/dispersion step of dissolving and/or dispersing a radical-polymerizable monomer,
(2) polymerization step of preparing resin microparticles,
(3) coagulation/fusion step of allowing resin microparticle and colorant microparticles to coagulate and fuse to form core particles (associated particles),
(4) first ripening step of ripening the associated particles with heat energy to control the particle form,
(5) shelling step of adding particulate resin used for a shell to a dispersion of the core particles (associated particles) to allow the resin used for a shell to be coagulated and fused onto the surface of the core particles to form colored particles exhibiting a core/shell structure,
(6) second ripening step for ripening the colored particles of a core/shell structure with heat energy to control the form of the colored particles,
(7) washing step of separating the colored particles from a cooled dispersion of colored particles to remove surfactants and the like from the colored particles;
(8) drying step of the washed colored particles, and optionally
(9) a step of adding external additives to the dried colored particles.

In the preparation of the toner of the invention, firstly, resin microparticles and colorant particles are coagulated with each other and fused to form colored particles as core particles. Then, particulate resin is added to a dispersion of the core particles to allow the particulate resin to coagulate and fuse onto the surface of the core particles to form colored particles having a core/shell structure. Thus, the toner particles of the invention are prepared by adding particulate resin to a dispersion of core particles prepared by various methods to be fused onto the core particles to form toner particles of a core/shell structure.

The toner relating to the invention preferably has a core/shell structure to simultaneously achieve enhancements of low temperature fixability and storage stability. Further, the shell thickness is preferably extremely thin and uniform, and therefore, after shell formation, the toner particles preferably are those with a small size and a uniform shape. To form toner particles having such a structure and a shape, it is preferred that core particles are made as uniform a size and a shape as possible, followed by shell formation with adding particulate resin for the shell. Shape control of the final toner particles is preferably performed during the shelling stage to provide the optimal shape. It is therefore essential to form core particles with uniform size and shape. A particulate resin is uniformly adhered to the surface of such toner particles, leading to formation of toner particles with uniform shell thickness.

Cores of the toner particles are prepared by coagulation and fusion of resin microparticles and colorant particles. The shape of core particles is controlled by adjusting the heating temperature in the coagulation/fusion step and the heating temperature and time in the first ripening step of the foregoing, time control of the first ripening step is most effective. The ripening step aims to control the circularity degree of associated particles and the associated particles become a shape close to a circle upon prolonging the ripening step.

The core portion of toner particles is formed preferably as follows. A releasing agent component is dissolved or dispersed in a polymerizable monomer to form a resin and then mechanically dispersed in an aqueous medium to polymerize the monomer through mini-emulsion polymerization to form composite resin microparticles The thus formed resin microparticles and colorant particles are subjected to salting-out (or coagulation)/fusion. When dissolving a releasing agent component in a monomer, the releasing agent component may be dissolved through dissolution or melting.

There will be described the respective steps in the preparation of toners relating to the invention.

(1) Dissolution/Dispersion Step:

In this step, a releasing agent compound is dissolved in a radical-polymerizable monomer to prepare a monomer solution containing a releasing agent.

(2) Polymerization Step:

In one preferred embodiment of this step, wax is added to an aqueous medium containing a surfactant at a concentration less than the critical micelle concentration (CMC) to form droplets, while providing mechanical energy. Subsequently, a water-soluble radical polymerization initiator is added thereto to promote polymerization within the droplets. An oil-soluble polymerization initiator may be contained in the droplets. In the polymerization step, providing mechanical energy is needed to perform enforced emulsification to form droplets. Means for providing mechanical energy include those for providing strong stirring or ultrasonic energy, for example, a homomixer, an ultrasonic homogenizer or a Manton-Gaulin homomixer.

Resin microparticles containing a binder resin and a wax are obtained in the polymerization step The resin microparticles may be colored microparticles or non-colored ones. Colored microparticles can be obtained by polymerization of a monomer composition containing a colorant. In the case when using non-colored microparticles, in the coagulation/fusion step, a dispersion of colorant particles is added to a dispersion of resin microparticles to allow the resin microparticles and the colorant particles to be fused to obtain colored particles.

(3) Coagulation/Fusion Step:

A method for coagulation and fusion in the fusion step preferably is salting-out/fusion of resin microparticles (colored or non-colored resin microparticles) obtained in the above-described polymerization step. In the coagulation/fusion step, a particulate internal additive such as a releasing agent or a charge-controlling agent may be coagulated/fused together with resin microparticles and colorant particles.

The salting-out/fusion means that coagulation and fusion are concurrently promoted and when grown to an intended particle size, a coagulation-terminating agent is added thereto to stop growth of the particles and heating optionally continues to control the particle shape.

The aqueous medium used in the coagulation/fusion step refers to a medium that is mainly composed of water (at 50% by weight or more). A component other than water is a water-soluble organic solvent. Examples thereof include methanol, ethanol, isopropanol, butanol, acetone, methyl ethyl ketone and tetrahydrofuran.

The colorant particles can be prepared by dispersing a colorant in an aqueous medium. Thus, a colorant is dispersed in an aqueous medium containing surfactants at a concentration in water at least the critical micelle concentration (CMC). Dispersing machines used for dispersing the colorant are not specifically limited but preferably pressure dispersing machines such as an ultrasonic disperser, a mechanical homogenizer, a Manton-Gaulin homomixer or a pressure homogenizer, and a medium type dispersing machines such as a sand grinder, a Gettsman mil or a diamond fine mill. Usable surfactants include those described later. The colorant particles may be those which have been subjected to surface modification treatments. Surface modification of the colorant particles is affected, for example, in the following manner. A colorant is dispersed in a solvent and thereto, a surface-modifying agent is added and allowed to react with heating. After completion of the reaction, the colorant is filtered off, washed with the same solvent and dried to produce a surface-modified colorant (pigment).

The process of salting-out/fusion as a preferred method of coagulation/fusion is conducted, for example, in the following manner. To water containing resin microparticles and colorant particles is added an agent for salting out (hereinafter, also denoted as salting-out agent), e.g., alkali metal salts, alkaline earth metal salts or trivalent metal salts, at a concentration higher than the critical coagulation concentration. Subsequently, the mixture is heated at a temperature (° C.) higher than the glass transition temperature of the resin microparticles and also higher than the melting peak temperature to promote fusion concurrently with salting out. Of alkali metal salts and alkaline earth metal salts, alkali metals include, for example, lithium, potassium and sodium; and alkaline earth metals include magnesium calcium, strontium, and barium, of which potassium, sodium, magnesium, calcium and barium are preferred.

When performing coagulation and fusion through salting out and fusion, the mixture after adding a salting-out agent is permitted to stand preferably as short a time as possible. The reason therefor is not totally clear but there were produced problems such that the coagulation state of particles varied, the particle size distribution became unstable or the surface property of fused toner particles varied, depending on the standing time after being salted out. Addition of a salting-out agent needs to be conducted at a temperature lower than the glass transition temperature of the resin microparticles. The reason therefor is that addition of a salting-out agent at a temperature higher than the glass transition temperature promotes salting but and fusion of the resin microparticles but cannot control the particle size, resulting in formation of larger sized particles. The addition temperature, which is lower than the glass transition temperature, is usually in the range of 5 to 55° C., and preferably 10 to 45° C.

A salting-out agent is added at a temperature lower than the glass transition temperature of the resin microparticles and subsequently, the temperature is promptly increased to a temperature higher than the glass transition temperature of the resin microparticles and also higher than the melting peak temperature (° C.) of the mixture. The temperature is increased preferably over a period of less than 1 hr. The temperature needs to be promptly increased, preferably at a rate of 0.25° C./min or more. The upper temperature limit is not definite but instantaneously increasing the temperature abruptly causes salting out, rendering it difficult to control the particle size. The temperature is increased preferably at a rate of 5° C./min or less. In the fusion step, resin microparticles and any other particles are subjected to saltingout/fusion to obtain a dispersion of associated particles (core particles).

(4) First Ripening Step:

Subsequently, the heating temperature in the coagulation/fusion step and the heating temperature and time in the first ripening step is so controlled that the formed core particles are in the shape of being rugged. Concretely, the coagulation/fusion step is conducted at a relatively low heating temperature to retard the progress of resin particles being fused to each other, which promotes deformation, or the first ripening is controlled at a low heating temperature for a long period so that the formed core particles are in the form of being relatively uniform.

(5) Shelling Step:

In the shelling step, a dispersion of a particulate resin to be used for shelling is added to a dispersion of core particles and the resin particles for shelling coagulate and fuse with each other to permit the particulate resin to cover the surface of core particles, resulting in formation of colored particles. Specifically, a core particle dispersion is added to a dispersion of resin particles for shelling, while maintaining the temperature in the coagulation/fusion step and the first ripening step and stirring with heating further continues for several hours, while the resin particles are permitted to cover the core particle surface to form colored particles. The time for stirring with heating is preferably 1 to 7 hrs., and more preferably 3 to 5 hrs.

(6) Second Ripening Step:

When the colored particles reach the prescribed size through shelling, a stopping agent such as sodium chloride is added thereto to stop growth of particles. Thereafter, stirring with heating continues further for several hours to permit the resin particles to fuse onto the core particles. In the shelling step, a 10 to 500 nm thick shell is formed on the core particle surface. Thus, resin particles are fixed by melting together onto the core particle surface to form a shell, whereby round, uniform colored particles are formed. Further, the shape of colored particles can be controlled to be close to a sphere by extending the second ripening time or by raising the ripening temperature. Cooling, solid-liquid separation and washing step:

This step refers to a stage that subjects a dispersion of the foregoing colored particles to a cooling treatment (rapid cooling). Cooling is performed at a cooling rate of 1 to 20° C./min.

The cooling treatment is not specifically limited and examples thereof include a method in which a refrigerant is introduced from the exterior of the reaction vessel to perform cooling and a method in which chilled water is directly supplied to the reaction system to perform cooling.

In the solid-liquid separation and washing step, a solid-liquid separation treatment of separating colored particles from a colored particle dispersion is conducted, then cooled to the prescribed temperature in the foregoing step and a washing treatment for removing adhered material such as a surfactant or salting-out agent from a separated toner cake (wetted aggregate of colored particles aggregated in a cake form) is applied. In this step, a filtration treatment is conducted, for example, by a centrifugal separation, filtration under reduced pressure using a Nutsche tunnel or filtration using a filter press, but is not specifically limited.

Drying Step:

In this step, the washed toner cake is subjected to a drying treatment to obtain dried colored particles. Drying machines usable in this step include, for example, a spray dryer, a vacuum freeze-drying machine, or a vacuum dryer. Preferably used are a standing plate type dryer, a movable plate type dryer, a fluidized-bed dryer, a rotary dryer or a stirring dryer. The moisture content of the dried colored particles is preferably not more than 5% by weight, and more preferably not more than 2%. When colored particles that were subjected to a drying treatment are aggregated via a weak attractive force between particles, the aggregate may be subjected to a pulverization treatment. Pulverization can be conducted using a mechanical pulverizing device such as a jet mill, Henschel mixer, coffee mill or food processor.

External Addition Treatment:

In this step, the dried colored particles are optionally mixed with external additives to prepare a toner. There are usable mechanical mixers such as a Henschel mixer and a coffee mill. Incorporation of external additives, typified by inorganic particles is preferable in terms of providing flowability to a toner and controlling electrostatic-charging property.

Examples of external additives include inorganic or organic particles having a number average primary particle size of from 4 to 800 nm and incorporation of these particles results in improved flowability or electrostatic-charging property of a toner The kind of such external additives is not specifically limited but examples thereof include inorganic particles, organic particles and slipping agents, as below.

As inorganic particles are usable commonly known ones and preferred examples thereof include silica, alumina and strontium titanate particles. Such inorganic particles may optionally be subjected to a hydrophobilization treatment by use of a silane coupling agent or a titanium coupling agent.

Specific examples of silica particles include R-805, R-976, R-974, R-972, R-812, and R-809 which are commercially available from Nippon Aerosil Co., Ltd.; HVK-2150 and H-200 which are commercially available from Hoechst Co.; TS-720, TS-530, TS-610, H-5 and MS-5 which is commercially available from Cabot Co.

Examples of titania particles include T-805 and T-604 which are commercially available from Nippon Aerosil Co. Ltd.; MT-100S, MT-100B, MT-500BS, MT-600, MT-600SJA-1 which are commercially available from Teika Co.; TA-300SI, TA-500, TAF-130, TAF-510 and TAF-510T which as commercially available from Fuji Titan Co., Ltd.; IT-S, IT-OB and IT-OC which as commercially available from Idemitsu Kosan Co., Ltd.

Examples of alumina microparticles include RFY-C and C-604 which are commercially available from Nippon Aerosil Co., Ltd.; and TTO-55, commercially available from Ishihara Sangyo Co., Ltd.

Spherical organic microparticles having a number-average primary particle size of 10 to 2000 nm are usable as organic microparticles. Specifically, there is usable styrene or methyl methacrylate homopolymer or their copolymers.

There are also usable lubricants, such as long chain fatty acid metal salts to achieve enhanced cleaning ability or transferability. Examples of a long chain fatty acid metal salt include zinc, copper, magnesium, and calcium stearates; zinc, manganese, iron, copper and magnesium oleates; zinc, copper, magnesium, and calcium palmitates; zinc and calcium linolates; zinc and calcium ricinolates.

Such an external additive or lubricant is incorporated preferably in an amount of 0.1 to 10.0% by weight of the total toner. The external additive or lubricant can be incorporated by using commonly known mixing devices such as a turbuler mixer, a HENSCHEL MIXER, a Nauter mixer or a V-shape mixer.

Toners relating to the invention are usable as a single component developer (inclusive of magnetic and nonmagnetic ones) which performs image formation without using a carrier and as a two component developer which performs image formation with using a carrier.

A two component developer is prepared by mixing a toner and magnetic particles as a carrier. The mixing ratio of a toner to a carrier is preferably from 1 to 10% by mass. The volume average particle size of a carrier is preferably from 15 to 100 μm, and more preferably from 25 to 80 μm. There are usable a commonly known material selected from metals such as iron, ferrite and magnetite, and alloys of such metals with a metal such as aluminum or lead. Of these, ferrite particles are preferred. Specific examples of a preferred carrier include a ferrite carrier having a volume average particle size of 10 to 60 μm and a saturated magnetic susceptibility of 20 to 80 emu/g.

The use of a carrier of a relatively small particle size and a relatively low saturated magnetic susceptibility softens a magnetic brush on a developing sleeve, rendering it feasible to form electrophotographic images of superior sharpness.

The volume average particle size refers to a volume-based average particle size which is measured by a laser diffraction particle size analyzer HELOS (product by Sympatec Co.). The saturated magnetic susceptibility can also measured by DC magnetization characteristic automatic recorder 3257-35 (product by Yokogawa Denki Co., Ltd.).

There is preferred a carrier in which magnetic particles are used as a core and the core surface is covered with a resin. Resin used for coverage of the core is not specifically limited and a variety of resins are usable. There are usable, for example, a fluororesin, fluoro-acryl resin, silicone resin and modified silicone resin for a positive charged toner, and a condensed silicone resin specifically preferred. There are also usable for a negative-charged toner, for example, an acryl-styrene resin, a mixed resin of an acryl-styrene resin and a melamine resin and its cured resin, silicone resin, modified silicone resin, an epoxy resin, polyester resin, a urethane resin, and a polyethylene resin; of these are preferred a mixed resin of an acryl-styrene resin and a melamine resin and its cured resin and condensed silicone resin. There may optionally incorporated a charge controlling agent, a contact-enhancing agent, a primer treating agent or a resistance controlling agent. A carrier production apparatus is not specifically limited but a. Nauter mixer, W cone or V0type mixer is usable.

The use of the toner of the invention as a two-component developer enables full-color printing by using a tandem system image forming apparatus, as described later. Further, appropriate selection of a resin and a wax constituting a toner enables full-color printing corresponding to low-temperature fixing in which a paper temperature is approximately 100° C. in fixing.

When used as a nonmagnetic single-component developer without a carrier to perform image formation, a toner is charged with being rubbed or pressed onto a charging member or the developing roller surface. Image formation in a nonmagnetic single-component development system can simplify the structure of a developing device, leading to a merit of compactification of the whole image forming apparatus. Therefore, the use of the toner of the invention as a single-component developer can achieve full-color printing in a compact printer, making it feasible to prepare full-color prints of superior color reproduction even in a space-limited working environment.

There will be described image formation using the toner of the invention. First, there will be described image formation using the toner of the invention as a two-component developer.

A toner relating to the invention is applicable to an image forming method in which fixing is conducted by using a fixing roller at a temperature of not more than 150° C., preferably not more than 130° C. The toner relating to the invention exhibits sufficient storage stability and durability irrespective of a thin surface-covering shell and such a thinned shell can achieve fixing within a shorter duration, rendering it suitable for low temperature fixing.

FIG. 1 illustrates an example of an image forming apparatus in which a toner relating to the invention is usable, and sowing a sectional view thereof. An image forming apparatus 1, as illustrated in FIG. 1, is a digital type image forming apparatus, which comprises an image reading section A, an image processing section B, an image forming section C and a transfer paper conveyance section D as a means for conveying transfer paper.

An automatic manuscript feeder to automatically convey a manuscript is provided above the image reading section. A manuscript placed on a manuscript-setting table 11 is conveyed sheet by sheet by a manuscript-conveying roller 12 and read at a reading position 13*a* to read images A manuscript having finished manuscript reading is discharged onto a manuscript discharge tray 14 by the manuscript-conveying roller 12.

On the other hand, the image of a manuscript placed on a platen glass 13 is read by a reading action, at a rate of v, of a first mirror unit 15 constituted of a lighting lamp and a first mirror, followed by conveyance at a rate of v/2 toward a second mirror unit 16 constituted of a second mirror and a third mirror which are disposed in a V-form.

The thus read image is formed through a projection lens 17 onto the acceptance surface of an image sensor CCD as a line sensor. Aligned optical images formed on the image sensor CCD are sequentially photo-electrically converted to electric signals (luminance signals), then subjected A/D conversion and further subjected to treatments such as density conversion and a filtering treatment in the image processing section B, thereafter, the image data is temporarily stored in memory.

In the image forming section C, a drum-form photoreceptor 21 as an image bearing body and in its surrounding, a charger 22 (charging step) to allow the photoreceptor 21 to be charged, a potential sensor 220 to detect the surface potential of the charged photoreceptor, a developing device 23 (development step), a transfer conveyance belt device 45 as a transfer means (the transfer step), a cleaning device 26 (cleaning step) for the photoreceptor 21 and a pre-charge lamp (PCL) 27 as a photo-neutralizer (photo-neutralizing step) are disposed in the order to carry out the respective operations. A reflection density detector 222 to measure the reflection density of a patch image developed on the photoreceptor 21 is provided downstream from the developing means 23. The photoreceptor 21, which employs an organic photoreceptor relating to the invention, is rotatably driven clockwise, as indicated.

After having been uniformly charged by the charger 22, the rotating photoreceptor 21 is imagewise exposed through an exposure optical system as an imagewise exposure means 30 (imagewise exposure step), based on image signals called up from the memory of the image processing section B. The exposure optical system as an imagewise exposure means 30 of a writing means employs a laser diode, not shown in the drawing, as an emission light source and its light path is bent by a reflecting mirror 32 via a rotating polygon mirror 31, a fθ lens 34 and a cylindrical lens 35 to perform main scanning. Imagewise exposure is conducted at the position of Ao to the photoreceptor 21 and an electrostatic latent image is formed by rotation of the photoreceptor (sub-scanning). In one of the embodiments, the character portion is exposed to form an electrostatic latent image.

In the illustrated image forming apparatus, a semiconductor laser at a 350-800 nm oscillating wavelength or a light-emitting diode is preferably used as a light source for imagewise exposure. Using such a light source for imagewise exposure, an exposure dot diameter in the main scanning direction of writing can be narrowed to 10-100 μm and digital exposure can be performed onto an organic photoreceptor to realize an electrophotographic image exhibiting a high resolution of 400 to 2500 dpi (dpi: dot number per 2.54 cm). The exposure dot diameter refers to an exposure beam length (Ld, measured at the position of the maximum length) along the main-scanning direction in the region exhibiting an exposure beam intensity of not less than $1/e^2$ of the peak intensity.

Utilized light beams include a scanning optical system using a semiconductor laser and a solid scanner of LED, while the light intensity distribution includes a Gaussian distribution and a Lorentz distribution, but the exposure dot diameter is defined as a region of not less than $1/e^2$ of the respective peak intensities.

An electrostatic latent image on the photoreceptor 21 is reversely developed by the developing device 23 to form a visible toner image on the surface of the photoreceptor 21. In the image forming method of the invention, thea developer used in the developing device preferably is a polymerization toner. The combined use of a polymerization toner which is uniform in shape and particle size distribution and the organic photoreceptor of the invention can obtain electrophotographic images exhibiting superior sharpness.

In the transfer paper conveyance section D, paper supplying units 41(A), 41(B) and 41(C) as a transfer paper housing means for housing transfer paper P differing in size are provided below the image forming unit and a paper hand-feeding unit 42 is laterally provided, and transfer paper P chosen from either one of them is fed by a guide roller 43 along a conveyance route 40. After the fed paper P is temporarily stopped by paired paper feeding resist rollers 44 to make correction of tilt and bias of the transfer paper P, paper feeding is again started and the paper is guided to the conveyance route 40, a transfer pre-roller 43*a*, a paper feeding route 46 and entrance guide plate 47. A toner image on the photoreceptor 21 is transferred onto the transfer paper P at the position of Bo, while being conveyed with being put on a transfer conveyance belt 454 of a transfer conveyance belt device 45 by a transfer pole 24 and a separation pole 25. The transfer paper P is separated from the surface of the photoreceptor 21 and conveyed to a fixing device 50 by the transfer conveyance belt 45.

The fixing device 50 has a fixing roller 51 and a pressure roller 52 and allows the transfer paper P to pass between the fixing roller 51 and the pressure roller 52 to fix the toner by heating and pressure. The transfer paper P which has completed fixing of the toner image is discharged onto a paper discharge tray 64.

Image formation on one side of transfer paper is described above and in the case of two-sided copying, a paper discharge switching member 170 is switched over, and a transfer paper guide section 177 is opened and the transfer paper P is conveyed in the direction of the dashed arrow. Further, the transfer paper P is conveyed downward by a conveyance mechanism 178 and switched back in a transfer paper reverse section 179, and the rear end of the transfer paper P becomes the top portion and is conveyed to the inside of a paper feed unit 130 for two-sided copying.

The transfer paper P is moved along a conveyance guide 131 in the paper feeding direction, transfer paper P is again fed by a paper feed roller 132 and guided into the transfer route 40. The transfer paper P is again conveyed toward the direction of the photoreceptor 21 and a toner is transferred onto the back surface of the transfer paper P, fixed by the fixing device 50 and discharged onto the paper discharge tray 64.

In an image forming apparatus relating to the invention, constituent elements such as a photoreceptor, a developing device and a cleaning device may be integrated as a process cartridge and this unit may be freely detachable. At least one of an electrostatic charger, an image exposure device, a transfer or separation device and a cleaning device is integrated with a photoreceptor to form a process cartridge as a single detachable unit from the apparatus body and may be detachable by using a guide means such as rails in the apparatus body.

Figure 2:
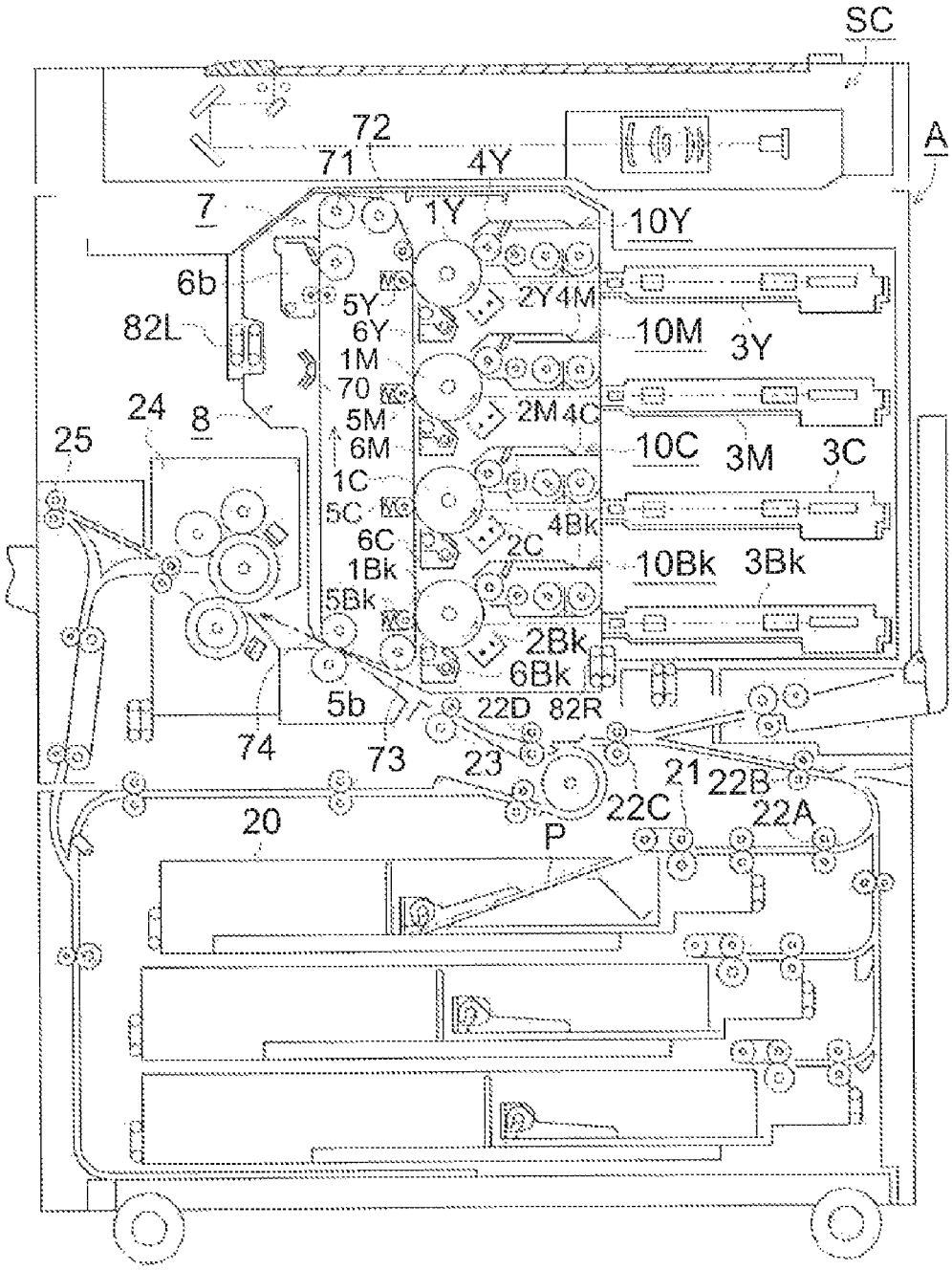
FIG. 2 illustrates a sectional view of a color image forming apparatus usable in the invention.

FIG. 2 illustrates a sectional view of a color image forming apparatus in which a toner relating to the invention is usable.

This image forming apparatus is called a tandem color image forming apparatus, which is, as a main constitution, comprised of four image forming sections (image forming units) 10Y, 10M, 10C and 10Bk; an intermediate transfer material unit 7 of an endless belt form, a paper feeding and conveying means 21 and as a fixing means 24. Original image reading device SC is disposed in the upper section of image forming apparatus body A.

Image forming section 10Y to form a yellow image comprises a drum-form photoreceptor 1Y as the first photoreceptor; an electrostatic-charging means 2Y (electrostatic-charging step), an exposure means 3Y (exposure step), a developing means 4Y (developing step), a primary transfer roller 5Y (primary transfer step) as a primary transfer means; and a cleaning means 6Y, which are disposed around the photoreceptor 1Y. An image forming section 10M to form a magenta image comprises a drum-form photoreceptor 1M as the second photoreceptor; an electrostatic-charging means 2M, an exposure means 3M and a developing means 4M, a primary transfer roller 5M as a primary transfer means; and a cleaning means 6M, which are disposed around the photoreceptor 1M. An image forming section 10C to form a cyan image formed on the respective photoreceptors comprises a drum-form photoreceptor 1C as the third photoreceptor, an electrostatic-charging means 2Y 2C, an exposure means 3C, a developing means 4C, a primary transfer roller 5C as a primary transfer means and a cleaning means 6C, all of which are disposed around the photoreceptor 1C. An image forming section 10Bk to form a black image formed on the respective photoreceptors comprises a drum-form photoreceptor 1Bk as the fourth photoreceptor; an electrostatic-charging means 2Bk, an exposure means 3Bk, a developing means 4Bk, a primary transfer roller 5Bk as a primary transfer means and a cleaning means 6Bk, which are disposed around the photoreceptor 1Bk.

The foregoing four image forming units 10Y, 10M, 10C and 10Bk are comprised of centrally-located photoreceptor drums 1Y, 1M, 1C and 1Bk; rotating electrostatic-charging means 2Y, 2M, 2C and 2Bk; imagewise exposure means 3Y, 3M, 3C and 3Bk; rotating developing means 4Y, 4M, 4C and 4Bk; and cleaning means 5Y, 5M, 5C and 5Bk for cleaning the photoreceptor drums 1Y, 1M, 1C and 1Bk.

The image forming units 10Y, 10M, 10C and 10Bk are different in color of toner images formed in the respective photoreceptors 1Y, 1M, 1C and 1Bk but are the same in constitution, and, for example, the image forming unit 10Y will be described below.

The image forming unit 10Y disposes, around the photoreceptor 1Y, an electrostatic-charging means 2Y (hereinafter, also denoted as a charging means 2Y or a charger 2Y), an exposure means 3Y, developing means (developing step) 4Y, and a cleaning means 5Y (also denoted as a cleaning blade 5Y, and forming a yellow (Y) toner image on the photoreceptor 1Y In this embodiment, of the image forming unit 10Y, at least the photoreceptor unit 1Y, the charging means 2Y, the developing means 4Y and the cleaning means 5Y are integrally provided.

The charging means 2Y is a means for providing a uniform electric potential onto the photoreceptor drum 1Y. In the embodiment, a corona discharge type charger 2Y is used for the photoreceptor 1Y.

The imagewise exposure means 3Y is a mean which exposes, based on (yellow) image signals, the photoreceptor drum 1Y having a uniform potential given by the charger 2Y to form an electrostatic latent image corresponding to the yellow image. As the exposure means 3Y is used one composed of an LED arranging emission elements arrayed in the axial direction of the photoreceptor drum 1Y and an imaging device (trade name: SELFOC Lens), or a laser optical system.

In the image forming apparatus relating to the invention, the above-described photoreceptor and constituting elements such as a developing device and a cleaning device may be integrally combined as a process cartridge (image forming unit), which may be freely detachable from the apparatus body. Further, at least one of a charger, an exposure device, a developing device, a transfer or separating device and a cleaning device is integrally supported together with a photoreceptor to form a process cartridge as a single image forming unit which is detachable from the apparatus body by using a guide means such as a rail of the apparatus body.

Intermediate transfer unit 7 of an endless belt form is turned by plural rollers and has intermediate transfer material 70 as the second image carrier of an endless belt form, while being pivotably supported.

The individual color images formed in image forming sections 10Y, 10M, 10C and 10Bk are successively transferred onto the moving intermediate transfer material (70) of an endless belt form by primary transfer rollers 5Y, 5M, 5C and 5Bk, respectively, to form a composite color image. Recording member P of paper or the like, as a final transfer material housed in a paper feed cassette 20, is fed by paper feed and a conveyance means 21 and conveyed to a secondary transfer roller 5*b* through plural intermediate rollers 22A, 22B, 22C and 22D and a resist roller 23, and color images are secondarily transferred together on the recording member P. The color image-transferred recording member (P) is fixed by a heat-roll type fixing device 24, nipped by a paper discharge roller 25 and put onto a paper discharge tray outside a machine. Herein, a transfer support of a toner image formed on the photoreceptor, such as an intermediate transfer body and a transfer material collectively means a transfer medium.

After a color image is transferred onto a transfer material P by a secondary transfer roller 5*b* as a secondary transfer means, an intermediate transfer material 70 of an endless belt form which separated the transfer material P removes any residual toner by cleaning means 6*b*.

During the image forming process, the primary transfer roller 5Bk is always in contact with the photoreceptor 1Bk. Other primary transfer rollers 5Y, 5M and 5C are each in contact with the respectively corresponding photoreceptors 1Y, 1M and 1C only when forming a color image.

The secondary transfer roller 5*b* is in contact with the intermediate transfer material 70 of an endless belt form only when the transfer material P passes through to perform secondary transfer.

A housing 8, which can be pulled out from the apparatus body A through supporting rails 82L and 82R, is comprised of image forming sections 10Y, 10M, 10C and 10Bk and the endless belt intermediate transfer unit 7.

Image forming sections 10Y, 10M, 10C and 10BK are aligned vertically. The endless belt intermediate transfer material unit 7 is disposed on the left side of photoreceptors 1Y, 1M, 1C and 1Bk, as indicated in FIG. 2. The intermediate transfer material unit 7 comprises the endless belt intermediate transfer material 70 which can be turned via rollers 71, 72, 73 and 74, primary transfer rollers 5Y, 5M, 5C and 5Bk and cleaning means 6*b*.

Figure 3:
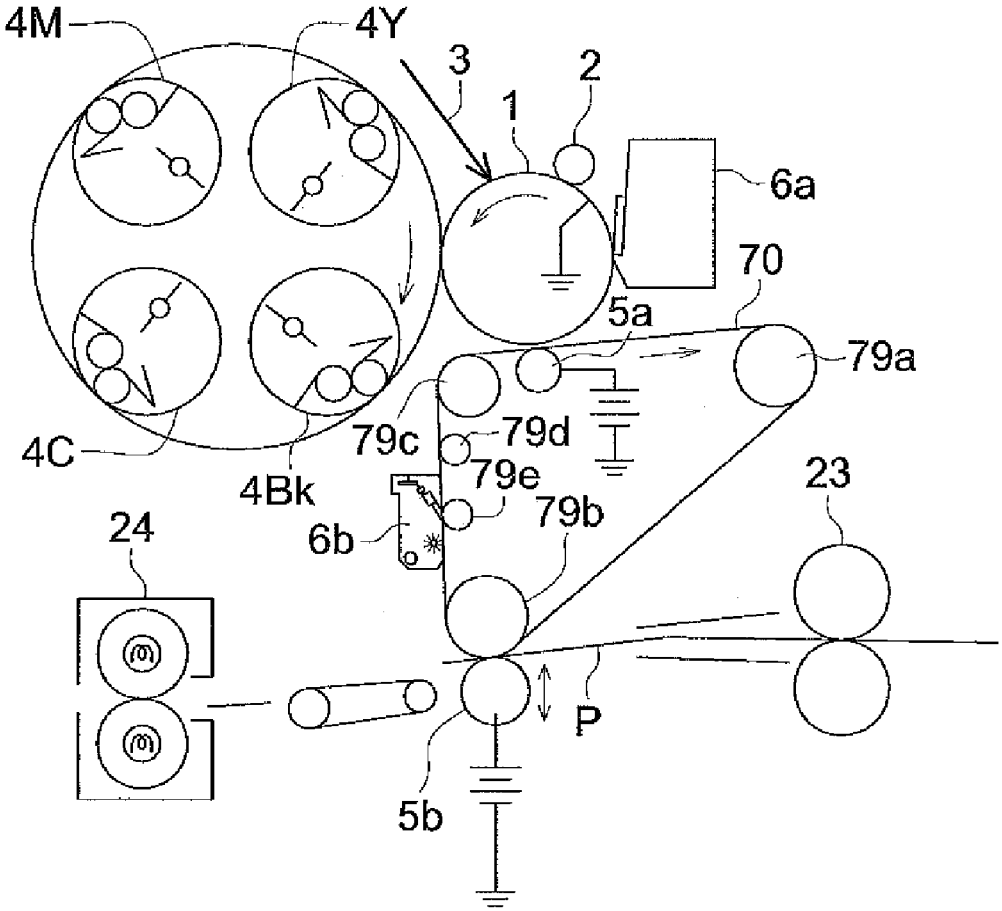
FIG. 3 illustrates a sectional view of a color image forming apparatus usable in the invention.

FIG. 3 illustrates a sectional view of a color image forming apparatus differing from one of FIG. 2. The color image forming apparatus of FIG. 3 comprises, around the organic photoreceptor, an electrostatic-charging means, an exposure means, plural developing means, a transfer means, a cleaning means and an intermediate transfer means.

The numeral 1 designates a rotary drum type photoreceptor, which is repeatedly used as an image forming body, is rotatably driven anticlockwise, as indicated by the arrow, at a moderate circumferential speed.

The photoreceptor 1 is uniformly subjected to an electrostatic-charging treatment at a prescribed polarity and potential by a charging means 2 (charging step), while being rotated. Subsequently, the photoreceptor 1 is subjected to imagewise exposure via an imagewise exposure means 3 (imagewise exposure step) by using scanning exposure light of a laser beam modulated in correspondence to the time-series electric digital image signals of image data to form an electrostatic latent image corresponding to a yellow (Y) component image (color data) of the objective color image.

Subsequently, the thus formed electrostatic latent image is developed by a yellow toner of a first color in a yellow (Y) developing means 4Y: developing step (the yellow developing device). At that time, the individual developing devices of the second to fourth developing means 4M, 4C and 4Bk (magenta developing device, cyan developing device, black developing device) are in operation-off and do not act onto the photoreceptor 1 and the yellow toner image of the first color is not affected by the second to fourth developing devices.

The intermediate transfer material 70 is rotatably driven clockwise at the same circumferential speed as the photoreceptor 1, while being tightly tensioned onto rollers 79*a*, 79*b*, 79*c*, 79*d* and 79*e*.

The yellow toner image formed and borne on the photoreceptor 1 is successively transferred (primary-transferred) onto the outer circumferential surface of the intermediate transfer material 70 by an electric field formed by a primary transfer bias applied from a primary transfer roller 5*a* to the intermediate transfer material 70 in the course of being passed through the nip between the photoreceptor 1 and the intermediate transfer material 70.

The surface of the photoreceptor 1 which has completed transfer of the yellow toner image of the first color is cleaned by a cleaning device 6*a*.

In the following, a magenta toner image of the second color, a cyan toner image of the third color and a black toner image of the fourth color are successively transferred onto the intermediate transfer material 70 and superimposed to form superimposed color toner images corresponding to the intended color image.

A secondary transfer roller 5*b*, which is allowed to bear parallel to a secondary transfer opposed roller 79*b*, is disposed below the lower surface of the intermediate transfer material 70, while being kept in the state of being separable.

The primary transfer bias for transfer of the first to fourth successive color toner images from the photoreceptor 1 onto the intermediate transfer material 70 is at the reverse polarity of the toner and applied from a bias power source. The applied voltage is, for example, in the range of +100 V to +2 kV.

In the primary transfer step of the first through third toner images from the photoreceptor 1 to the intermediate transfer material 70, the secondary transfer roller 5*b* and the cleaning means 6*b* for the intermediate transfer material are each separable from the intermediate transfer material 70.

The superimposed color toner image which was transferred onto the intermediate transfer material 70 is transferred to a transfer material P as the second image bearing body in the following manner. Concurrently when the secondary transfer roller 5*b* is brought into contact with the belt of the intermediate transfer material 70, the transfer material P is fed at a prescribed timing from paired paper-feeding resist rollers 23, through a transfer paper guide, to the nip in contact with the belt of the intermediate transfer material 70 and the secondary transfer roller 5*b*. A secondary transfer bias is applied to the second transfer roller 5*b* from a bias power source. This secondary bias transfers (secondary-transfers) the superimposed color toner image from the intermediate transfer material 70 to the transfer material P as a secondary transfer material. The transfer material P having the transferred toner image is introduced to a fixing means 24 and is subjected to heat-fixing.

The image forming apparatus relating to the invention is not only suitably used for general electrophotographic apparatuses such as an electrophotographic copier, a laser printer, an LED printer and a liquid crystal shutter type printer, but is also broadly applicable to apparatuses employing electrophotographic technologies for a display, recording, shortrun printing, printing plate making, facsimiles and the like.

EXAMPLES

The present invention will be further described with reference to examples but the embodiments of the invention are by no means limited to these. In the following examples, "part(s)" represents part(s) by mass unless otherwise noted.

Preparation of Poly-branched Resin Composition

Poly-Branched Resin Composition 1:

Styrene was used as a radical-polymerizable monomer and benzoyl peroxide as a polymerization initiator was added thereto in an amount of 2000 ppm, based on the mass of styrene. Further thereto, 1,6-hexyleneglycol dimethacrylate as a compound having at least two vinyl groups was added in an amount of 125 ppm, based on the mass of styrene. A monomer solution was thus prepared. Subsequently, the monomer solution was heated to a temperature of 108° C., and while maintaining the temperature, the monomer solution was continuously supplied to the first reaction vessel at a supplying rate of 4 liter/hr to perform polymerization. Then, the foregoing solution was supplied from the first reaction vessel to a second reaction vessel and then further to a third reaction vessel to perform polymerization under a temperature of 145° C., thereafter, volatile components were removed by a vent-fitted extruder, whereby poly-branched resin composition 1 was prepared.

Poly-Branched Resin Composition 2:

Poly-branched resin composition 2 was prepare in the same manner as the foregoing poly-branched resin composition 1, except that the radical-polymerizable monomer was changed to a mixture of 67% by mass of styrene and 33% by mass of butyl acrylate.

Poly-Branched Resin Composition 3:

Poly-branched resin composition 3 was prepare in the same manner as the foregoing poly-branched resin composition 1, except the polymerization initiator was changed to 2,2-bis(4,4-di-tert-butylperoxycyclohexyl)propane in an amount of 2000 ppm, based on the mass of styrene, and the compound having at least two vinyl groups was changed to trimethylolpropane trimethacrylate in an amount of 92 ppm, based mass of styrene.

Poly-Branched Resin Composition 4:

Poly-branched resin composition 4 was prepare in the same manner as the foregoing poly-branched resin composition 1, except that the radical-polymerizable monomer was changed to a mixture of 67% by mass of styrene and 33% by mass of butyl acrylate Poly-Branched Resin Composition 5:

Poly-branched resin composition 5 was prepare in the same manner as the foregoing poly-branched resin composition 1, except that the polymerization initiator was changed to tris(t-butylperoxide)triazine in an amount of 250 ppm, based on the mass of the radical polymerizable monomer; ethylene glycol bisthioglycorate as a poly-functional chain transfer agent was added in an amount of 200 ppm, based on the mass of the radical-polymerizable monomer; and benzoyl peroxide was added in an amount of 250 ppm, based mass of radical-polymerizable monomer.

Poly-Branched Resin Composition 6:

First, a poly-branched macromonomer was synthesized In a reactor fitted with a stirrer, a dropping funnel, a temperature sensor and nitrogen-introducing tube was dissolved 35 parts by mass of 4-bromo(ethyleneoxy)phenylacetonitrile in 800 parts by mass of dimethylsulfoxide under a nitrogen atmosphere. After heating the interior of the reactor to 35° C., an aqueous 50% sodium hydroxide solution was dropwise added over 3 min. and stirred for 2 hrs. with maintaining the temperature inside the reactor at 30° C. to obtain a precursor of a macromonomer. Then, 50 parts by mass of 4-chloromethylstyrene was dropwise added to the foregoing poly-branched macromonomer and stirred for 2 hrs. to obtain a poly-branched macromonomer solution.

Then, 2000 parts by mass of deionized water were added to a reaction vessel fitted with a stirrer and further thereto, 10 parts by mass of a saponified polyvinyl alcohol and 0.06 parts by mass of sodium dodecylbenzenesulfonate were added and allowed to dissolve.

Subsequently, a monomer solution was prepared in the following manner. In 820 parts by mass of styrene was dissolved 0.63 parts by mass of the foregoing poly-branched macromonomer and further thereto were added 180 parts by mass of n-butyl acrylate, 2.8 parts by mass of benzoyl peroxide and 0.6 part by mass of t-butylperoxybenzoate to prepare a monomer solution.

The thus prepared monomer solution was placed into a reaction vessel and after the inside of the reaction vessel was replaced by nitrogen, polymerization reaction was undergone at 90° C. for 6 hrs., while stirring. Subsequently, the inside of the reaction vessel was heated to 113° C. and polymerization reaction was further continued for 3 hrs. Thereafter, volatile components were removed by a vent-fitted extruder, whereby poly-branched resin composition 6 was prepared. The thus prepared poly-branched resin composition 6 exhibited a linear-reduced mass average molecular weight ($M_wL$) of 350,000, a mass average branch number (nw) of 0.48 and a glass transition temperature of 51° C.

Comparative Resin Composition 1:

Comparative resin composition 1 was prepare in the same manner as the afore-described poly-branched resin composition 1, except that 1,6-hexylene glycol dimethacrylate was not added.

Comparative Resin Composition 2:

Comparative resin composition 2 was prepared in the same manner as the afore-described poly-branched resin composition 2, except that 1,6-hexylene glycol dimethacrylate was not added.

The foregoing resin compositions are shown in Table 1 with respect to linear-reduced mass average molecular weight ($M_wL$), ratio of linear-reduced (z+1)-average molecular weight $[M_{(z+1)}L]$ to $M_wL$ {that is $[M_{(z+1)}L]/M_wL$}, mass average molecular weight ($M_wB$) and mass average branch number ($N_w$)

TABLE 1

| | $M_wL$ | $[M_{(z+1)}L]/M_wL$ | $M_wB$ | $N_w$ |
|---|---|---|---|---|
| Poly-branched resin composition 1 | 240000 | 4.9 | 28000 | 0.42 |
| Poly-branched resin composition 2 | 250000 | 4.9 | 285000 | 0.42 |
| Poly-branched resin composition 3 | 271000 | 6.1 | 320000 | 0.45 |
| Poly-branched resin composition 4 | 280000 | 6.2 | 340000 | 0.47 |
| Poly-branched resin composition 5 | 305000 | 7.5 | 490000 | 1.25 |
| Poly-branched resin composition 6 | 350000 | 5 | 480000 | 0.48 |
| Comparative resin composition 1 | 30000 | 2.7 | 303000 | 0.02 |
| Comparative resin composition 2 | 30000 | 2.7 | 304000 | 0.02 |

Preparation Of Resin Particle Dispersion

Resin Particle Dispersion 1:

There were mixed 201 parts by mass of styrene, 117 parts by mass of butyl acrylate and 18.3 parts by mass of methacrylic acid to prepare a monomer mixture solution. The monomer mixture solution was heated to 80° C. with stirring and further thereto were gradually added and dissolved 172 parts by mass of behenyl behenate and 48.5 parts by mass of the poly-branched resin composition 1.

Subsequently, an aqueous surfactant solution of 11.3 parts by mass of an anionic surfactant, EMAL E-27C (a product a KAO Co., Ltd., at an effective content of 27%) dissolved in 1182 parts by mass of pure water was heated to 80° C. and added to the foregoing monomer mixture solution and stirred at a high-speed to prepare a monomer dispersion.

Then, 867.5 parts by mass of pure water was added into a polymerization device fitted with a stirrer, a condenser, a temperature sensor and a nitrogen-introducing tube and the internal temperature of the device was adjusted to 80° C. with stirring under a nitrogen gas stream. The foregoing monomer dispersion was added into the polymerization device and further thereto was added an aqueous polymerization initiator solution of 8.55 g of potassium persulfate dissolved in 162.5 parts by mass of pure water.

After addition of the aqueous polymerization initiator solution, 5.2 parts by mass of n-octylmercatan was further added thereto over 35 min. and a polymerization reaction was conducted at 80° C. over 2 hr. Subsequently, an aqueous polymerization initiator solution of 9.96 parts by mass of potassium persulfate dissolved in 189.3 parts by mass of pure water was added, and a mixed monomer solution of 366.1 parts by mass of styrene, 179.1 parts by mass of butyl acrylate and 7.2 parts by mass of n-octylmercaptan was dropwise added over 1 hr. After completion of addition, a polymerization reaction was conducted over 2 hrs. and then, the reaction mixture was cooled to room temperature to prepare a resin particle dispersion 1.

Resin Particle Dispersion 2:

Resin particle dispersion 2 was prepared in the same manner as the foregoing resin particle dispersion 1, except that the poly-branched resin composition 1 was replaced by 97 parts by mass of the poly-branched resin composition 2.

Resin Particle Dispersion 3:

Resin particle dispersion 3 was prepared in the same manner as the foregoing resin particle dispersion 1, except that the poly-branched resin composition 1 was replaced by the poly-branched resin composition 3.

Resin Particle Dispersion 4:

Resin particle dispersion 4 was prepared in the same manner as the foregoing resin particle dispersion 2, except that the poly-branched resin composition 2 was replaced by the poly-branched resin composition 4.

Resin Particle Dispersion 5:

Resin particle dispersion 5 was prepared in the same manner as the foregoing resin particle dispersion 2, except that the poly-branched resin composition 2 was replaced by the poly-branched resin composition 5.

Resin Particle Dispersion 6:

Resin particle dispersion 6 was prepared in the same manner as the foregoing resin particle dispersion 1, except that the poly-branched resin composition 1 was replaced by the poly-branched resin composition 6.

Comparative Resin Particle Dispersion 1:

Comparative resin particle dispersion 1 was prepared in the same manner as the foregoing resin particle dispersion 1, except that the poly-branched resin composition 1 was replaced by the comparative resin particle composition 1.

Comparative Resin Particle Dispersion 2:

Comparative resin particle dispersion 2 was prepared in the same manner as the foregoing resin particle dispersion 2, except that the poly-branched resin composition 2 was replaced by the comparative resin particle composition 2.

Preparation Of Resin Particle Dispersion For Shelling

Into a polymerization device fitted with a stirrer, a condenser, a nitrogen-introducing tube and a temperature sensor were added 2948 parts by mass of pure water and 2.3 parts by mass of an anionic surfactant, EMAL 2FG (product by KAO Co., Ltd.) and dissolved with stirring and heated to a temperature of 80° C. under nitrogen gas stream. Then, 520 parts by mass of styrene, 184 parts by mass of butyl acrylate, 96 parts by mass of methacrylic acid and 22.1 parts by mass of n-octylmercaptan were mixed to prepare a monomer mixture solution. Separately, 10.2 parts by mass of potassium persulfate was dissolved in 218 parts by mass of pure water to prepare an aqueous polymerization initiator solution. The aqueous polymerization initiator solution was placed into the polymerization device and the foregoing monomer mixture solution was dropwise added thereto over 3 hrs., thereafter, polymerization reaction was continued for 1 hr. and then, the reaction mixture was cooled to room temperature. There was thus prepared resin particle dispersion used for shelling. The thus prepared resin particles for shelling exhibited a mass average molecular weight of 13,200 and mass average particle size of 82 nm.

Preparation of Colorant Particle Dispersion

Cyan Colorant Particle Dispersion:

In 160 parts by mass of pure water was dissolved 11.5 parts by mass of sodium dodecylsulfate and thereto, 25 parts by mass of C.I. Pigment Blue 15:3 was gradually added and then dispersed by CLEAR MIX W-motion CLM-0.8 (product by M Technique Co.). According to the foregoing procedure, there was prepared a dispersion of cyan colorant particles exhibiting a volume average particle size of 153 nm.

Magenta Colorant Particle Dispersion:

A dispersion of magenta colorant particles exhibiting a volume average particle size of 183 nm was prepared in the same manner as the foregoing cyan colorant particle dispersion, except that C.I. Pigment Blue 15:3 was replaced by C.I. Pigment Red 122.

Yellow Colorant Particle Dispersion:

A dispersion of yellow colorant particles exhibiting a volume average particle size of 177 nm was prepared in the same manner as the foregoing cyan colorant particle dispersion, except that C.I. Pigment Blue 15:3 was replaced by C.I. Pigment Yellow 74.

Carbon Black Particle Dispersion:

A dispersion of carbon black particles exhibiting a volume average particle size of 167 nm was prepared in the same manner as the foregoing cyan colorant particle dispersion, except that C.I. Pigment Blue 15:3 was replaced by carbon black.

Preparation Of Toner Particle

Toner Particle 1:

The foregoing resin particle dispersion 1 at a solid content of 350 parts by mass, 670 parts by mass of deionized water and the foregoing cyan colorant particle dispersion at a solid content of 130 parts by mass were placed into a reactor fitted with a stirrer, a temperature sensor and a condenser. While maintaining an internal temperature of the reactor at 30° C., the pH was adjusted to 10 by adding an aqueous 5 mol/liter sodium hydroxide solution.

Subsequently, an aqueous solution of 5.76 parts by mass of magnesium chloride hexahydrate dissolved in 47.88 parts by mass of deionized water was dropwise added over 10 min. and then heated to 75° C. to initiate coagulation. Meanwhile, the size of particles was observed by Coulter Counter TA-II (product by Beckman Coulter Co.) and stirring was continued with heating until reached a volume average particle size of 6.5 μm.

When the volume average particle size reached 6.5 μm, the foregoing resin particle dispersion for shelling was added thereto in a solid content of 210 parts by mass and stirring was continued for 1 hr. to allow the resin particles for shelling to be fused. Stirring was further continued for 30 min. to complete shell layer formation and then, an aqueous solution of 62 parts by mass of sodium chloride dissolved in 250 parts by mass of deionized water was added, and after the internal temperature was raised to 78° C. and stirring was continued for 1 hr., the temperature was lowered to room temperature, whereby particles were formed. The thus formed particles were repeatedly washed with deionized water and then dried with hot air of 35° C. to obtain toner particle 1. The thus obtained toner particle 1 exhibited a volume average particle size of 6.48 μm and an average circularity of 0.965, which were determined by Coulter Counter TA-II and FPIA 2000 (product by Sysmex Co.), respectively.

Toner Particle 2:

Toner particle 2 was prepared in the same manner as the foregoing toner particle 1, except that the resin particle dispersion 1 was replaced b y the resin particle dispersion 2. The toner particle 2 exhibited a volume average particle size of 6.52 μm and an average circularity of 0.968.

Toner Particle 3:

Toner particle 3 was prepared in the same manner as the foregoing toner particle 1, except that the resin particle dispersion 1 was replaced by the resin particle dispersion 3. The toner particle 2 exhibited a volume average particle size of 6.43 μm and an average circularity of 0.958.

Toner Particle 4:

Toner particle 2 was prepared in the same manner as the foregoing toner particle 1, except that the resin particle dispersion 1 was replaced by the resin particle dispersion 4. The toner particle 2 exhibited a volume average particle size of 6.62 μm and an average circularity of 0.958.

Toner Particle 5:

Toner particle 5 was prepared in the same manner as the foregoing toner particle 1, except that the resin particle dispersion 1 was replaced by the resin particle dispersion 5. The toner particle 5 exhibited a volume average particle size of 6.39 μm and an average circularity of 0.969.

Toner Particle 6:

Toner particle 6 was prepared in the same manner as the foregoing toner particle 5, except that the cyan colorant particle dispersion was replaced by the magenta colorant particle dispersion. The toner particle 6 exhibited a volume average particle size of 6.71 μm and an average circularity of 0.964.

Toner Particle 7:

Toner particle 7 was prepared in the same manner as the foregoing toner particle 5, except that the cyan colorant particle dispersion was replaced by the yellow colorant particle dispersion. The toner particle 7 exhibited a volume average particle size of 6.51 μm and an average circularity of 0.970.

Toner Particle 8:

Toner particle 5 was prepared in the same manner as the foregoing toner particle 5, except that the cyan colorant particle dispersion was replaced by carbon black particle dispersion. The toner particle 8 exhibited a volume average particle size of 6.71 μm and an average circularity of 0.951.

Toner Particle 9:

Toner particle 5 was prepared in the same manner as the foregoing toner particle 1, except that the resin particle dispersion 1 was replaced by the resin particle dispersion 6. The toner particle 5 exhibited a volume average particle size of 6.39 μm and an average circularity of 0.969.

Comparative Toner Particle 1:

Comparative toner particle 1 was prepared in the same manner as the foregoing toner particle 1, except that the resin particle dispersion 1 was replaced by the comparative resin particle dispersion 1. The comparative toner particle 1 (also denoted as Comp. 1) exhibited a volume average particle size of 6.53 μm and an average circularity of 0.950.

Comparative Toner Particle 2:

Comparative toner particle 2 was prepared in the same manner as the foregoing toner particle 1, except that the resin particle dispersion 1 was replaced by the comparative resin particle dispersion 2. The comparative toner particle 1 (also denoted as Comp. 2) exhibited a volume average particle size of 6.72 μm and an average circularity of 0.949.

External Treatment Of Toner Particle

A hydrophobic silica (having a number average primary particle size of 12 nm and a hydrophobicity of 68) and a hydrophobic titanium oxide (having a number average primary particle size of 20 nm and a hydrophobicity of 64) were added each in an amount of 1% by mass to each of the thus prepared toner particles 1 through 9 and comparative toner particles 1 and 2 and mixed by a Henschel mixer (product by Mitsui Miike Kakoki Co., Ltd.). Thereafter, coarse particles were removed by using a sieve having a 45 μm opening to obtain Toners 1-9 and Comparative toners 1-2.

Each of the toners was mixed with a carried of particulate ferrite covered with a styrene-acryl resin, having an average particle size of 35 so that the toner concentration was 8% whereby developers 1-9 and comparative developers 1-2 were prepared.

Evaluation

Evaluations were made by using developers 1-9 prepared from toners 1-9 with respect to the followings, which were denoted as Examples 1-9 and also by using comparative developers 1-2 prepared from comparative toners 1-2, which were denoted as Comparative Examples 1-2, as shown in Table 1.

Offset Evaluation:

Commercially available copier bizhub PRO C500 (product by Konica Minolta business Technologies Inc.) was employed as a machine for evaluation. An installed fixing device was modified and the surface temperature of a heated roller for fixing (which was measured in the central portion of the roller) was varied at intervals 5° c. in the range of 120 to 210° C. In the respective surface temperatures, an A4 image having a 5 mm wide, solid black belt-formed image which was arranged vertically to the conveyance direction was longitudinally conveyed to be fixed; then, an A4 image having a 5 mm wider solid black belt-formed image and a 20 mm wide halftone image which were arranged vertically to the conveyance direction was laterally conveyed to be fixed, and the maximum temperature at which image staining due to fixing offset occurred was determined.

Fixing Rate:

A fixing rate (percentage) was evaluated in such a manner that a sheet onto which a solid black image formed by each of the foregoing developers was transferred was fixed under an environment of 10° C. and 10% RH, and a fixing rate (percentage) of the fixed image was calculated for evaluation. Thus, samples were prepared with varying the surface temperature of a heated roller at intervals of 5° C. in the range of 130 to 210° C. and after a fixed image sample was folded down, rubbing was repeated with cloth ten times by use of friction fastness tester. A reflection density before or after being rubbed was measured by using a reflection densitometer RD-918 and a measured value was applied to the following equation to determine a fixing rate.

Measurement was carried out, while the initial density was adjusted to a relative reflection density of 140, based on the density of paper being zero.

Fixing rate=(density after being rubbed)/[density before being rubbed(=1.40)]×100(%)

Evaluation was made in terms of a minimum temperature at which the fixing rate is at least 80% as a level acceptable in practical use.

Evaluation results are shown in Table 2.

TABLE 2

| | Toner No. (Developer No.) | Fixing Rate (° C.)* | Offset Resistance (° C.)** |
|---|---|---|---|
| Example 1 | 1 | 145 | 135 |
| Example 2 | 2 | 140 | 130 |
| Example 3 | 3 | 150 | 140 |
| Example 4 | 4 | 140 | 130 |
| Example 5 | 5 | 135 | 130 |
| Example 6 | 6 | 135 | 125 |
| Example 7 | 7 | 135 | 125 |
| Example 8 | 8 | 135 | 125 |
| Example 9 | 9 | 130 | 120 |
| Comparison 1 | Com. 1 | 185 | 170 |
| Comparison 2 | Com. 2 | 170 | 160 |

*Minimum temperature at which a fixing rate of 80% is achieved

**Maximum temperature at which fixing offset is caused

As shown in Table 2, it was proved that Examples 1-9 using Toners 1-9 composed of a binder resin containing a poly-branched resin composition in an amount of 0.5 to 20% by mass, were superior in low temperature fixability and exhibited lower offset-causing temperature. Thus, it was confirmed that Examples 1-9 achieved simultaneously offset resistance and low temperature fixability. On the contrary, Comparative Examples 1-2 using comparative toners 1-2 composed of a binder resin containing no poly-branched resin composition.

What is claimed is:

1. A method producing an electrophotographic toner comprising toner particles, the method comprising:

(a) dissolving at least a poly-branched resin composition radical-polymerizable monomer to form a monomer mixture, (b) emulsifying the monomer mixture to form a monomer emulsion (c) subjecting the monomer emulsion to polymerization to form resin microparticles containing a poly-branched resin and (d) subjecting the resin microparticle and colorant microparticles to coagulation and fusion to form the toner particles, wherein the poly-branched resin composition is prepared by a process of adding a polymerization initiator to a mixture of a compound having at least two vinyl groups and a radical-polymerizable monomer to perform polymerization.

2. The method of claim 1, wherein the compound having at least two vinyl groups is at least one selected from the group consisting of a divinylbenzene, an alkylene glycol di(meth) acrylate, a polyoxyalkylene glycol di(meth)acrylate, a compound having three vinyl groups, a compound having four vinyl groups and a poly-branched macromonomer having a branched chain containing repeating unit represented by the following formula (1):

formula (1)

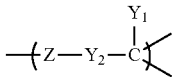

wherein $Y_1$ is an electron-withdrawing group selected from the group consisting of —CN, —$NO_2$, —$CONH_2$, —$CON(R)_2$, —$SO_2CH_3$, and —P(═O)$(OR)_2$ in which R is an alkyl group or an aryl group; $Y_2$ is a group selected from the group consisting of an arylene group, —O—OO— and —NH—CO—; Z is a group selected from the group consisting of —$(CH_2O)_n$—, —$(CH_2CH_2O)_n$— and —$(CH_2CH_2CH_2O)_n$—, and when $Y_2$ is —O—CO— or —NH—CO—, Z is a group selected from the group consisting of —$(CH_2)_n$—, —$(CH_2)_n$—Ar—, —$(CH_2O)_n$—Ar—, —$(CH_2CH_2O)_n$—Ar— and —$(CH_2CH_2CH_2O)_n$—Ar—, in which Ar is an arylene group.

3. The method of claim 2, wherein the compound having at least two vinyl groups is an alkylene glycol di(meth)acrylate.

4. The method of claim 2, wherein the compound having at least two vinyl groups is a compound having three vinyl groups.

5. The method of claim 2, wherein the compound having at least two vinyl groups is a poly-branched macromonomer represented by the formula (1).

6. The method of claim 1, wherein the compound having at least two vinyl groups is in an amount of 1 to 1500 ppm, based on mass of the radical-polymerizable monomer.

7. A method of producing an electrophotographic toner comprising toner particles, the method comprising:

(a) dissolving at least a poly-branched resin composition in a radical-polymerizable monomer to form a monomer mixture, (b) emulsifying the monomer mixture to form a monomer emulsion, (c) subjecting the monomer emulsion to polymerization to form resin microparticles containing a poly-branched resin and (d) subjecting the resin microparticle and colorant microparticles to coagulation and fusion to form the toner particles, wherein the poly-branched resin composition is prepared by a process of adding a chain transfer agent having at least two chain transfer units to a radical-polymerizable monomer to perform polymerization.

8. The method of claim 7, wherein the chain transfer agent having at least two chain transfer units is a compound represented by the formula (2)

$$R\text{-}[(A)_m\text{-}SH]_n \qquad \text{Formula (2)}$$

wherein R is an aliphatic having 1 to 17 carbon atoms, an aromatic group or an organic group containing at least one heteroatom, A is an organic group, S is a sulfur atom, m is an integer of 0 or 1 and n is an integer of 2 to 4.

9. A method of roducin an electrophotographic toner comprising toner particles, the method comprising:

(a) dissolvinq at least a poly-branched resin composition in a radical-polymerizable monomer to form a monomer mixture, (b) emulsifying the monomer mixture to form a monomer emulsion, (c) subjecting the monomer emulsion to polymerization to form resin microparticles containing a poly-branched resin and (d) subjecting the resin microparticle and colorant microparticles to coagulation and fusion to form the toner particles, wherein the poly-branched resin composition is prepared by a process of adding a polymerization initiator having at least two radical polymerization initiator units to a radical-polymerizable monomer to perform polymerization.

10. The method of claim 9, wherein the polymerization initiator having at least two radical polymerization initiator units is a compound represented by the formulas (3)-(5):

formula (3)

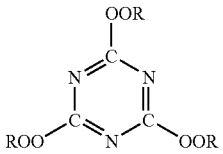

wherein R is a tertiary alkyl group;

formula (4)

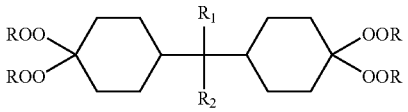

wherein R is a tertiary alkyl group or a tertiary aralkyl group, and $R_1$ and $R_2$ are each an alkyl group having one or two carbon atoms;

formula (5)

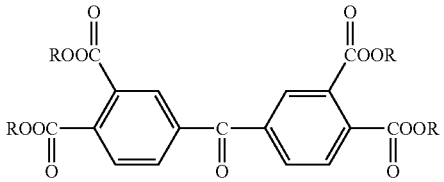

wherein R is a tertiary alkyl group or a tertiary aralkyl group.

* * * * *